US011052654B2

(12) United States Patent
Watanabe et al.

(10) Patent No.: US 11,052,654 B2
(45) Date of Patent: Jul. 6, 2021

(54) DROPLET DISPENSING DEVICE

(71) Applicants: WATANABE MFG. CO., LTD., Toyonaka (JP); RISETEC CO., LTD., Kobe (JP)

(72) Inventors: Masao Watanabe, Toyonaka (JP); Yasuo Watanabe, Toyonaka (JP); Susumu Shoji, Kobe (JP)

(73) Assignees: Watanabe Mfg. Co., Ltd., Toyonaka (JP); Risetec Co. Ltd., Kobe (JP)

( * ) Notice: Subject to any disclaimer, the term of this patent is extended or adjusted under 35 U.S.C. 154(b) by 55 days.

(21) Appl. No.: 16/485,856

(22) PCT Filed: Oct. 26, 2017

(86) PCT No.: PCT/JP2017/038810
§ 371 (c)(1),
(2) Date: Aug. 14, 2019

(87) PCT Pub. No.: WO2018/150640
PCT Pub. Date: Aug. 23, 2018

(65) Prior Publication Data

US 2020/0055311 A1 Feb. 20, 2020

(30) Foreign Application Priority Data

Feb. 15, 2017 (JP) ..... JP2017-026444

(51) Int. Cl.
*B41J 2/045* (2006.01)
*B41J 2/04* (2006.01)

(52) U.S. Cl.
CPC ..... *B41J 2/04508* (2013.01); *B41J 2/04* (2013.01); *B41J 2/04586* (2013.01)

(58) Field of Classification Search
CPC ..... B41J 2/04508; B41J 2/04586; B41J 2/04; B05B 9/043; B05B 11/3001;
(Continued)

(56) References Cited

U.S. PATENT DOCUMENTS 4,162,037 A 7/1979 Koyoma
2005/0279771 A1 12/2005 Navarro
(Continued)

FOREIGN PATENT DOCUMENTS

CN 2242132 Y 12/1996
CN 2648992 Y 10/2004
(Continued)

OTHER PUBLICATIONS

PCT/JP2017/038810 (related application) WIPO Search Report dated Nov. 28, 2017.
(Continued)

*Primary Examiner* — Henok D Legesse
(74) *Attorney, Agent, or Firm* — Schott, P.C.

(57) ABSTRACT

A droplet jetting apparatus includes: a nozzle that ejects a jet of liquid droplets; a detector that detects a hand or an object in a flight path of liquid droplets from the nozzle; a pump including a suction portion for suction of liquid, and a discharge portion which is connected to the nozzle and discharges the liquid which has been sucked into the suction portion; a driver which by rotation of a cam, sucks liquid into the pump and discharges the liquid in a compressed state; and controller which actuates the driver. When the detector detects the hand or object, the controller actuates the pump by rotation of the cam, and ejects a jet of liquid in droplet form from the nozzle.

10 Claims, 16 Drawing Sheets

(58) Field of Classification Search
CPC .... B05B 12/122; B65D 83/267; B65D 83/00; F04F 5/10; B43M 11/00
See application file for complete search history.

(56) References Cited

U.S. PATENT DOCUMENTS

| | | | | |
|---|---|---|---|---|
| 2007/0169576 | A1* | 7/2007 | Ophardt | F16H 21/44 74/47 |
| 2013/0108521 | A1 | 5/2013 | Ikushima | |

FOREIGN PATENT DOCUMENTS

| | | | |
|---|---|---|---|
| CN | 1655876 | A | 8/2005 |
| CN | 1775375 | A | 5/2006 |
| CN | 101678948 | A | 3/2010 |
| CN | 202174028 | U | 3/2012 |
| CN | 202761150 | U | 3/2013 |
| JP | 53-144014 | A | 12/1978 |
| JP | 10-080468 | A | 3/1998 |
| JP | 2004-209358 | A | 7/2004 |
| JP | 2005-231662 | A | 9/2005 |
| JP | 2006-150933 | A | 6/2006 |
| JP | 2009-072748 | A | 4/2009 |
| JP | 3153609 | U | 8/2009 |
| JP | 3159252 | U | 4/2010 |
| JP | 2010-522080 | A | 7/2010 |
| JP | 2011-209153 | A | 10/2011 |
| JP | 2012-20427 | A | 12/2012 |
| JP | 2012-250427 | A | 12/2012 |
| WO | 2008-115391 | A2 | 9/2008 |
| WO | 2008115391 | A2 | 9/2008 |

OTHER PUBLICATIONS

Statement of Relevance of Non-English References Issued from China National Intellectual Property Administration within the Chinese Patent Application No. 201780086593.X, May 10, 2021, 8 pages.

* cited by examiner

RELATIONSHIP BETWEEN LIQUID FLIGHT DISTANCE AND SPREAD DIAMETER

DROPLET DISPENSING DEVICE

TECHNICAL FIELD

The present invention relates to a droplet jetting apparatus employing a jetting technique to eject a jet of liquid in a required little amount with one movement of a reciprocating piston, and more particularly, to a droplet jetting apparatus that, upon detection of a liquid droplet-impingement target object including a hand, ejects a jet of a predetermined amount of liquid droplets so that the liquid droplets can adhere to the target.

BACKGROUND

Examples of heretofore known small-sized liquid jetting apparatuses include: a hand-operated sprayer; a device including a valve-equipped enclosure containing a liquefied gas, viz., a gas-liquid mixture in aerosol form or a set of compressed gas and liquid for intended use, in which the liquid for intended use is jetted from a nozzle under gas pressure; a compressor-using spray device; an electrostatic spray device; an ultrasonic spray device; and a jetting apparatus designed on an ink-jet principle.

Such a liquid sprayer or technique for ejection of liquid stored in a liquid jetting apparatus in a jet as above described finds wide variety of applications, including a dispenser for liquid application, a printer that necessitates the function of emitting fine spray, a spray device that ejects liquid for intended application as fine mist in a wide-spreading jet, a disinfection device that ejects an antiseptic solution in a spreading jet to disinfect a hand, etc., a hand wetting instrument, and a hand wetting device. Examples of proposed hand wetting instruments and hand wetting devices include: a device that ejects a jet of water or the like from a discharge opening by manual operation to press a press member; a device that ejects a jet of atomized particles of water or steam from a jet opening upon detection of human body; and a device that operates its compressor in a manner to deliver air to spray a solution upon detection of human body with a human-body detection sensor (refer to Patent Literatures 1 to 8, for example).

SUMMARY OF INVENTION

In a device for wetting a hand, etc. from the prior art as disclosed in Patent Literature 3, an object or a hand is wet with liquid by direct contact. In this case, the device may become infected with bacteria as a result of contact with the object or hand, and this eventually leads to the growth of bacteria within the device. In this regard, Patent Literature 7 states that a non-contact system is preferable for use from a hygienic standpoint.

A manually operated device from the prior art as disclosed in Patent Literatures 1 and 2 has difficulty in ejection of a jet of liquid in a uniform little amount in one step by manual operation. A prior art device as disclosed in Patent Literatures 4 to 6 ejects too much a liquid in a jet to wet a small-area target surface such as a hand, a postage stamp, or a documentary stamp. Furthermore, due to the ejection of liquid in fine mist form, the spraying range is highly dependent on a distance from a nozzle, which results in unwanted spraying of liquid to wet superfluous regions.

For example, a hand-operated spray device is intended to emit fine spray. Even if the device is made compact, the spraying amount is high for its size. In addition, being built as a sprayer, the device has a wide liquid-spreading range, and thus has difficulty in letting a jet of liquid impinge on a small-area target. Compounding the problem, shared use of the device by an indefinite number of people may cause hygienic concerns such as the fear of an infectious disease. Also, a commonly-used portable sprayer, called an atomizer, sprays liquid in a spread-oriented manner, and thus has difficulty in letting a jet of predetermined amount of liquid impinge on a narrow region spaced away from the sprayer.

An aerosol spray device sprays liquid under gas pressure in a spread- and distance-oriented manner, and the spraying amount is high correspondingly. In addition, the device utilizes flammable gas, which entails cautions as to a place where it is used. Thus, the device does not lend itself to use in a place where an indefinite number of people gather, because the gas may be drawn directly into human lung.

In a compressor-using spray device, the use of a compressor, viz., a compression machine leads to an increase in size of the device. The large-sized device is unfit for placement on a desk or table. Furthermore, the ejection amount is high due to the compression of air, etc., and thus, the device is not adaptable to a system for ejection of a little amount of liquid in a jet. As disclosed in Patent Literature 8, with use of an electromagnetic valve for ejection amount control, the ejection amount of liquid can be adjusted to a very low level under electrical control. In this case, however, the device increases in size and in structural complexity, which results in an increase in manufacturing cost.

Furthermore, in the ultrasonic spray device disclosed in Patent Literature 7, liquid changes into fine mist. In this case, for example, bacteria-laden impurities also change into fine mist, and the mist may be drawn directly into human lung, causing health or hygienic concerns. Compounding the problem, in this prior art device, liquid tends to spread out under ultrasonic vibration. This makes it difficult to let a jet of required amount of liquid impinge on a target region without fail.

As to a jetting device employing ink-jet technology, an ink-jet system is a mechanism primarily devised for printing, and, in a compact ink-jet jetting device which is placed on a desk or table for use, of particular importance to the device is that liquid impinge on a target with high accuracy. That is, the device is designed for use with an object spaced only a short distance away therefrom, and is thus not adaptable to a system for ejecting a jet of liquid so that it can fly for a certain distance.

The prior art devices thus far described failed to eject a jet of a required little amount of liquid so that the liquid can fly for a predetermined distance so as to impinge on a narrow region with high accuracy without contact of the target with the device.

Furthermore, in a device for wetting a liquid droplet-impingement target object including a hand, for example, in a hand wetting device, as the amount of liquid required to wet a hand, considering that fingerprint pitch is 50 μm on average, that a fingertip in the first joint-to-extremity range has a surface area of 20 mm by 20 mm, that is; 400 $mm^2$, and that fingerprint depth is about 50 μm, then 0.02 ml of liquid is good enough to wet a hand. Unfortunately, there is no device that ejects such a little amount of liquid in a jet in one step. In the prior art device that ejects a jet of liquid by the operation of a press member, even if it is made compact, the ejection amount of liquid is greater than or equal to 0.05 ml, and also, the liquid is ejected in a spreading jet by pressing operation and consequently spreads out over a wide range. Compounding the problem, when a hand gets too close to a nozzle during the use of the device, the hand is completely wet, which results in dripping of the liquid from the hand.

The device for spraying liquid in a non-contact manner disclosed in Patent Literature 5, when it is fitted with a nozzle, ejects liquid in fine mist form upon detection of the insertion of a target object, and yet, after the removal of the nozzle, ejects liquid in an as-is state from a discharge opening. That is, the flow rate of the liquid is adjustable by the mounting and demounting of the nozzle. In this construction, however, an increase in the extent of pressurization and in the flow rate is necessary for the spraying of the liquid after the detection of hand insertion. Thus, the ejection amount of liquid cannot be adjusted to a very low level as intended without a nozzle.

The device disclosed in Patent Literature 7 utilizes a human-body detection sensor for controlling the spraying of atomized particles and a halt of spraying operation. When a user or user's fingertip comes near the device, the human-body detection sensor detects it, whereupon the device ejects atomized particles of water or steam from a jet opening during the approach of the fingertip, etc. In this construction, however, a jet of atomized particles of water or steam is ejected to an excessive degree, which results in an unnecessarily large amount of liquid consumption. In addition, the spread of sprayed atomized particles may exert an influence on people around the device. Also in the ultrasonic spray device, as described earlier, the possibility arises that impurities will be drawn directly into human lung. Such a device is unsuitable for use.

The device disclosed in Patent Literature 6 is built as an automatic hand cleaner employing a compressor for the spraying of liquid, which is made of large size at high cost. Furthermore, due to the use of a compressor, the compression of air cannot be simply made by using a battery or the like. In addition, being built as a sprayer, the device ejects liquid in a spreading jet, and the liquid may spread out to an excessive degree. Although Patent Literature 6 states that the device is designed to eject a jet of liquid in an amount less than or equal to one-tenth of the ejection amount in a commercially available pump in the range of 1 to 4 cc, no mention is made of means for achieving ejection of such a little amount of liquid.

The present invention has been devised to solve the technical problems as discussed supra, and accordingly an object thereof is to provide a simply structured, easily and inexpensively manufacturable droplet jetting apparatus that ejects a jet of a little amount of liquid so that the liquid can impinge on a liquid droplet-impingement target object with high accuracy, allows the liquid to fly for a required distance under high responsivity, and restrains the liquid from spreading by adjusting the area of the liquid impinging on the target object to be narrower than the area of the target object to avoid causing dripping of liquid droplets from the target object.

The invention provides a droplet jetting apparatus which is a compact liquid ejection device and ejects a jet of liquid in droplet form when placed on a predetermined mounting surface, including:

a nozzle that ejects a jet of liquid droplets in a predetermined direction;

detecting means that detects a liquid droplet-impingement target object including a hand in a flight path of liquid droplets from the nozzle, and upon detection of the liquid droplet-impingement target object, outputs a target detection signal;

a pump including a suction portion for suction of liquid, and a discharge portion which is connected to the nozzle and discharges the liquid which has been sucked into the suction portion;

driving means which includes a cam and by rotation of the cam, drives the pump to suck liquid and discharge the liquid in a compressed state; and control means which actuates the driving means in response to the detection signal, the control means operating the driving means in a manner to rotate the cam in response to the detection signal, actuates the pump by rotation of the cam, and ejecting a jet of predetermined amount of liquid in droplet form from the nozzle.

In the invention, it is preferable that the detecting means detects the liquid droplet-impingement target object at a distance within a range of 5 mm or more and 100 mm or less from the nozzle in the flight path of liquid droplets, and upon one rotation of the cam, the pump operates to eject a jet of liquid in an amount of 0.0005 ml or more so that an area of liquid droplet impingement can be narrower than an area of a liquid droplet-impingement target surface in an amount which avoids causing dripping of liquid droplets from the liquid droplet-impingement target surface, from the nozzle so as to fly for a flight distance of 5 mm or more from the nozzle.

Moreover, in the invention, it is preferable that the detecting means is an optical sensor or an ultrasonic sensor.

Moreover, in the invention, it is preferable that the cam has a first cam face extending from a suction starting point corresponding to a minimum radius of the cam, with an increase in radius in a rotation direction, to a suction ending point corresponding to a maximum radius of the cam just ahead of the suction starting point in the rotation direction, and a second cam face extending from the suction ending point to the suction starting point with a sharp decrease in radius in the rotation direction.

Moreover, in the invention, it is preferable that the driving means includes a lever coupled to the nozzle for rocking motion in contact with the cam face of the cam, and a spring that urges the lever in a direction to press the lever against the cam face, and in order that the liquid can be discharged out of the pump, with the lever kept in contact with the first cam face, the cam is rotated to produce a suction force for the pump to suck liquid, and with the lever kept in contact with the second cam face, the cam is rotated to rock the lever by a spring force of the spring.

Moreover, in the invention, it is preferable that the pump includes a piston, a cylinder that receives therein the piston, a pipe for passage of liquid, a first valve that is opened during sucking of liquid into the cylinder, and is closed during discharge of liquid out of the cylinder, and a second valve that is closed during sucking of liquid into the cylinder, and upon movement of the piston in a suction direction, the first valve is opened to allow liquid suction, and when liquid is jetted from a hole of the nozzle, the first valve is closed, whereas the second valve is opened for passage of the liquid through an interior of the pipe, and liquid droplets can be jetted from the nozzle.

Moreover, in the invention, it is preferable that, in the pipe, to eject a jet of liquid such that an ejection amount of liquid droplets from the nozzle obtained by one rotation of the cam is adjusted to 0.0005 ml or more and an area of liquid droplet impingement can be narrower than an area of a liquid droplet-impingement target surface to prevent liquid droplets from dripping from the liquid droplet-impingement target surface, a stroke of the piston is controlled with adjustment to a shift amount of the first cam face and the second cam face, or the pipe has an adjustment hole having an inside diameter smaller than an inside diameter of the pipe in a side surface thereof.

Moreover, in the invention, it is preferable that a suction capacity V2 for suction of liquid via the pump with one rotation of the cam is greater than a suction capacity V1 required for the pump to suck liquid flowing to the first valve, an inside diameter d2 of the adjustment hole of the pipe is greater than an inside diameter d1 of the nozzle hole, an outlet hole for discharge of leaked liquid from the adjustment hole is provided in an upper part of the cylinder which falls outside a range of movement of the piston, and an inside diameter d3 of the outlet hole is greater than or equal to the inside diameter d2 of the adjustment hole so that the leaked liquid from the adjustment hole of the pipe can be discharged through the outlet hole formed in the cylinder.

Moreover, in the invention, it is preferable that the liquid stored in the droplet jetting apparatus is contained in a replaceable container or a refillable container.

Moreover, in the invention, it is preferable that the control means exercises ON-OFF control of the detecting means with a pulse signal, and the pulse signal exhibits a period of 2 seconds or less, in which ON time accounts for 50% or less of the period.

Moreover, in the invention, it is preferable that the driving means includes a driving motor that rotates the cam, and when the detecting means outputs a detection signal, the control means allows that electric current is applied to the driving motor to drive the driving motor to run, and allows that electric current to the detecting means is interrupted to stop detecting operation of the detecting means, and when the cam rotationally moves to a predetermined rotational position, the control means allows that electric current to the driving motor is interrupted to stop the running of the driving motor, and allows that electric current is applied to the detecting means to allow the detecting means to start detecting operation.

According to the invention, with the droplet jetting apparatus placed on a predetermined mounting surface such as a desk or table, as a liquid droplet-impingement target object including a hand is approaching the flight path of liquid droplets, the detecting means detects the liquid droplet-impingement target object, and outputs a detection signal. Upon receipt of the detection signal from the detecting means, the control means actuates the driving means in response to the detection signal. Upon actuation of the driving means, the cam is rotated, and the pump acts to suck the liquid by rotation of the cam. The liquid which has been sucked into the pump is compressed, and is fed, through the discharge portion, to the nozzle. A predetermined amount of the liquid in the nozzle is jetted therefrom in droplet form so as to adhere to the liquid droplet-impingement target object in the flight path, so that the liquid droplet-impingement target object can be wet with an adequate amount of the liquid.

That is, the droplet jetting apparatus ejects a jet of adequate amount of liquid in droplet form by operating the pump under rotation of the cam. Thus, a simply structured droplet jetting apparatus can be manufactured with ease at low cost, and, this droplet jetting apparatus ejects a jet of liquid, even a little amount of liquid, in droplet form so that the liquid can fly for a required distance without spreading greatly under high responsivity.

Moreover, according to the invention, the detecting means detects the liquid droplet-impingement target object at a distance within the range of 5 mm or more and 100 mm or less from the nozzle in the path of flying liquid. Upon one rotation of the cam, the pump operates to eject a jet of liquid in an amount of 0.0005 ml or more from the nozzle so that the area of liquid droplet impingement can be narrower than the area of a liquid droplet-impingement target surface. That is, liquid droplets are ejected in an amount which avoids causing dripping of the liquid from the liquid droplet-impingement target surface so as to fly for a flight distance of 5 mm or more. Thus, even in a heavy traffic area or even when many people are getting near the apparatus from different directions, the apparatus responds only to the hand of one certain user or one certain liquid droplet-impingement target object, and then ejects a jet of adequate amount of liquid to adhere the liquid to the hand or the liquid droplet-impingement target object such as a postage stamp without wetting it excessively.

Moreover, according to the invention, the use of an optical sensor or an ultrasonic sensor for the detecting means makes it possible to detect the liquid droplet-impingement target object without contact between the droplet jetting apparatus and the liquid droplet-impingement target object, and thereby provide a clean and sanitary droplet jetting apparatus which is less prone to trouble such as infection and soiling.

Moreover, according to the invention, suction movement is imparted to the pump by rotational movement of the cam from the suction starting point to the suction ending point of the first cam face, and, discharge movement is imparted to the pump by rotational movement of the cam from the suction ending point to the suction starting point of the second cam face. Thus, ejection of a jet of desired amount of liquid can be achieved by adjusting the shift amount of the first cam face and the second cam face.

Moreover, according to the invention, the driving means includes the lever coupled to the nozzle for rocking motion in contact with the cam face of the cam, and the tension spring that urges the lever in a direction to press the lever against the cam face. This makes it possible to transmit the shift amount of the cam face based on rotation of the cam to the pump by simple means, and thereby provide a compact and simply structured droplet jetting apparatus for ejecting a desired amount of flying liquid in an appropriate manner at low cost.

Moreover, according to the invention, the pump includes: the piston; the cylinder that receives therein the piston; the pipe for the passage of liquid; the first valve that is opened during the sucking of liquid into the cylinder, and is closed during the discharge of liquid out of the cylinder; and the second valve that is closed during the sucking of liquid into the cylinder. Upon movement of the piston in a suction direction, the first valve is opened for the pump to suck the liquid, and, to jet the liquid from the hole of the nozzle, the first valve is closed, whereas the second valve is opened. After passing through the interior of the pipe, the liquid is ejected in droplet form from the nozzle. The first valve and the second valve may be formed of a simply structured check valve. In this case, the construction of the droplet jetting apparatus can be simplified with consequent easy production of the apparatus.

Moreover, according to the invention, in the pump mechanism, to eject a jet of liquid such that the ejection amount of liquid droplets from the nozzle obtained by one rotation of the cam is adjusted to 0.0005 ml or more and the area of liquid droplet impingement can be narrower than the area of a liquid droplet-impingement target object surface to prevent liquid droplets from dripping from the surface of the object, the stroke of the piston is controlled with adjustment to the shift amount of the first cam face and the second cam face, or the pipe has the adjustment hole having an inside diameter smaller than the inside diameter of the pipe in the side surface thereof. Thus, the ejection amount of liquid droplet can be controlled with high accuracy.

Moreover, according to the invention, the suction capacity V2 for suction of liquid via the pump with one rotation of the cam is greater than the suction capacity V1 required for suction of the liquid flowing to the first valve of the suction pipe, and, the inside diameter d2 of the adjustment hole of the nozzle-connected pipe is greater than the inside diameter d1 of the nozzle hole. This makes it possible to suck the liquid in the amount set for ejection, and draw it into the pump smoothly without fail. Ejection of a little amount liquid can be achieved by adjusting the inside diameter d2 of the adjustment hole. Moreover, the outlet hole for the discharge of leaked liquid from the adjustment hole is provided in the upper part of the cylinder which falls outside the range of movement of the piston. The inside diameter d3 of the outlet hole is greater than or equal to the inside diameter d2 of the adjustment hole. Thus, the leaked liquid from the adjustment hole formed in the side surface of the pipe can be discharged through the outlet hole formed in the cylinder. This makes it possible to discharge the liquid in excess of the ejection amount of liquid droplets smoothly without fail, and thereby ensure the required amount of liquid with consequent stabilization of the ejection amount of liquid droplet.

Moreover, according to the invention, the liquid stored in the droplet jetting apparatus is contained in a replaceable container or a refillable container. This makes it possible to replenish the droplet jetting apparatus with liquid with ease in a sanitary manner at the time of liquid exhaustion, and thereby provide a highly convenient droplet jetting apparatus.

Moreover, according to the invention, the detecting means is subjected to ON-OFF control by the control means using a pulse signal which exhibits a period of 2 seconds or less, in which ON time accounts for 50% or less of the period. This makes it possible to reduce the power requirement of the detecting means, and thereby provide a highly energy-efficient droplet jetting apparatus.

Moreover, according to the invention, the driving means includes a driving motor that rotatably drives the cam. Upon detection of a target by the detecting means, the control means allows that electric current is applied to the driving motor to drive the driving motor to run, and allows that the electric current to the detecting means is interrupted to stop the detecting operation of the detecting means, and, after interrupting the electric current to the driving motor to stop the running of the driving motor, the control means allows that electric current is applied to the detecting means to allow the detecting means to start detecting operation. That is, during the operation of the driving motor, the electric current to the detecting means is interrupted. This makes it possible to provide a droplet jetting apparatus that achieves greater energy efficiency.

Other and further objects, features, and advantages of the invention will be more explicit from the following detailed description taken with reference to the drawings.

DESCRIPTION OF EMBODIMENTS

Figure 1:
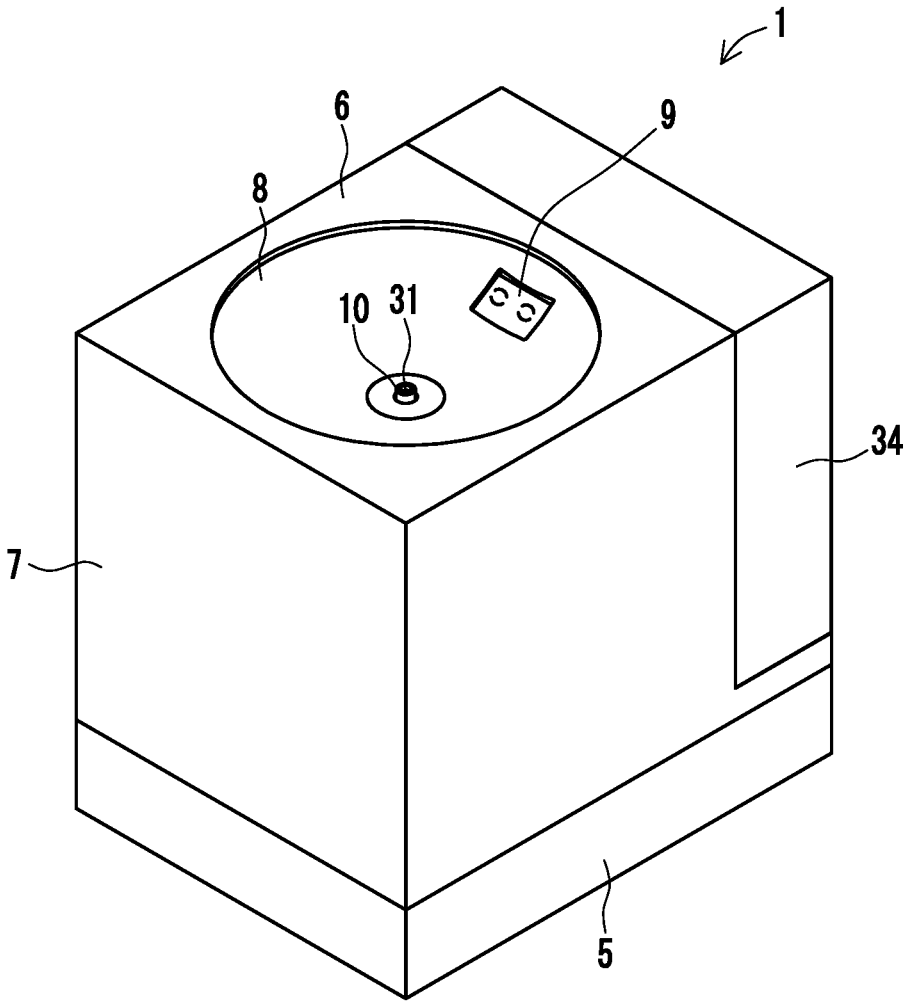
FIG. 1 is a perspective view showing an example of the outer appearance of the droplet jetting apparatus in accordance with one embodiment of the invention.

Now referring to the drawings, preferred embodiments of the invention are described below.

Figure 2:
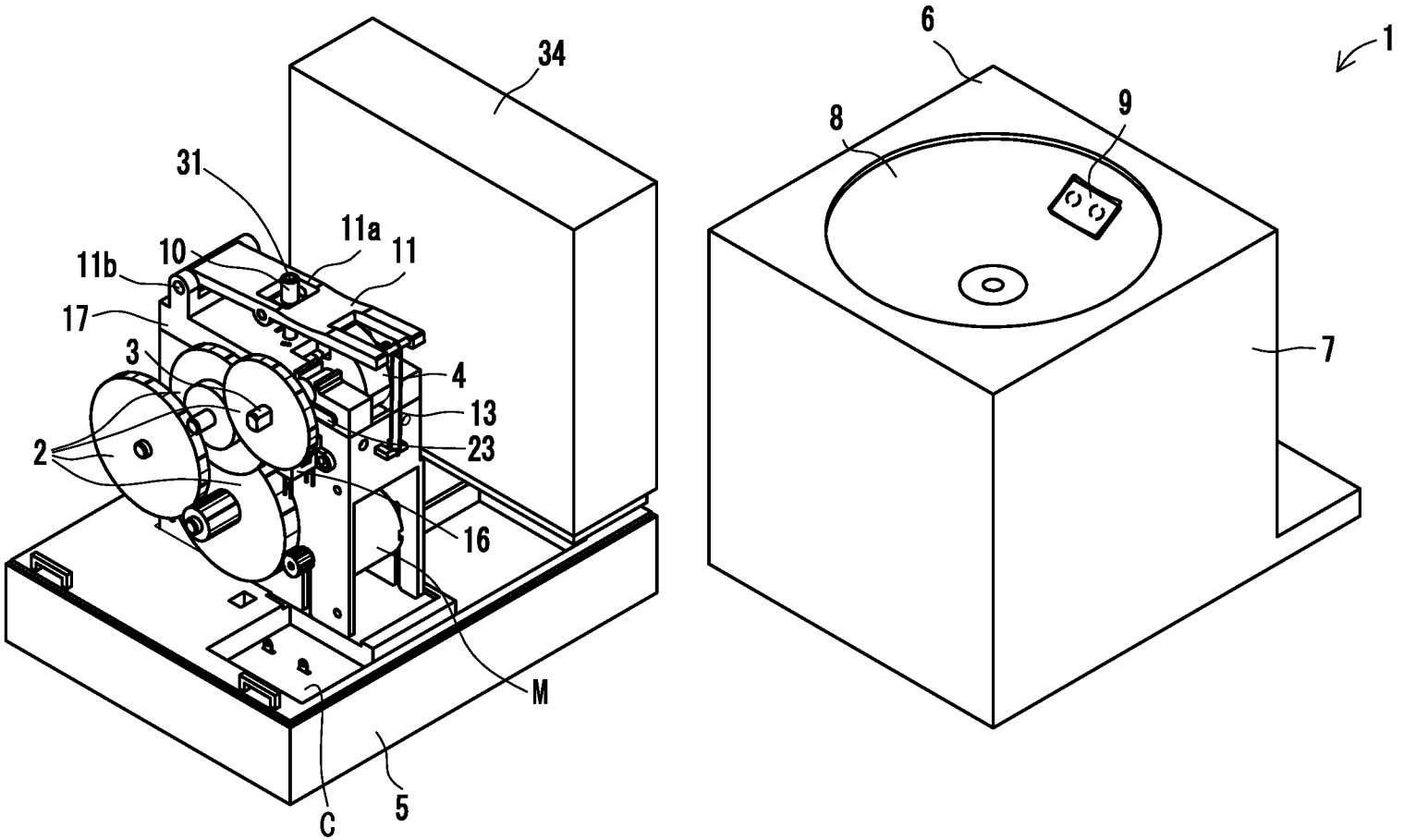
FIG. 2 is an exploded perspective view showing an example of the internal structure of the droplet jetting apparatus shown in FIG. 1.

FIG. 1 is a perspective view showing an example of the outer appearance of a droplet jetting apparatus 1 in accordance with one embodiment of the invention, and FIG. 2 is an exploded perspective view showing an example of the internal structure of the droplet jetting apparatus 1 shown in FIG. 1. The droplet jetting apparatus 1 according to this embodiment includes a driving motor M, which is a compact direct-current motor (hereafter also referred to as "DC motor M"), and a gear train 2 including a plurality of gear wheels for transmitting a driving force under the drive to the driving motor. In this construction, a cam 4 coupled to a shaft 3 is rotated by the gear train 2, and, a cam position detection sensor 16 detects the position of the cam 4 to set the cam 4 in place. The DC motor M and the gear train 2 constitute driving means.

By way of another embodiment of the invention, a pulley or belt system may be used instead of the gear train 2. The DC motor M, the gear train 2, the shaft 3, and the cam 4 are disposed in a main body 5 to which a main body cover 6 is detachably attached. In a peripheral wall 7 at one end of the main body cover 6 in the form of a rectangular tube, there is provided a bowl portion 8 whose shape is defined by part of a substantially spherical body. The bowl portion 8 includes an object detection sensor 9 serving as detecting means for detecting a liquid droplet-impingement target object including a hand. For example, an optical sensor including a light-emitting portion and a light-receiving portion forms the object detection sensor 9. For example, a light emitting diode (LED for short) may be used for the light-emitting portion, and, a photo diode (PD for short) or a photo transistor may be used for the light-receiving portion.

By way of another embodiment of the invention, an ultrasonic sensor may be used for the detecting means instead of the optical sensor including the light-emitting portion and the light-receiving portion. Moreover, for power to drive the DC motor M, it is possible to use a commercially available dry cell D, other battery, or AC power in an AC-DC converter. The use of a sensor for detection creates the need to apply an electric current to the sensor. In view of consumption of the dry cell D, the apparatus may be given the ability to automatically switch into the OFF state when detecting that it has been out of use for a predetermined period of time. Moreover, in the apparatus employing a battery or cell having a limited service life, a solar battery may be provided as means for the application of electric current to the sensor to retard exhaustion of a battery or cell in the apparatus.

The droplet jetting apparatus 1 is built as a compact liquid ejection device that ejects a jet of liquid in droplet form when placed on a predetermined mounting surface such as a desk or table. The droplet jetting apparatus 1 includes: a nozzle 10 that ejects a jet of liquid droplets in a predetermined direction e.g. a vertical upward direction; an object detection sensor 9 that detects a target such at least as a liquid droplet-impingement target object including a hand in a flight path of liquid droplets from the nozzle 10, and upon detection of the liquid droplet-impingement target object, outputs a target detection signal; a pump P including a suction portion for liquid suction, and a discharge portion, connected to the nozzle 10, for discharging the liquid which has been sucked into the suction portion; a gear train 2, which includes a cam 4, for driving the pump P to suck liquid and discharge the liquid in a compressed state by rotation of the cam 4; and control means C for actuating the driving means in response to the detection signal. Under the control of the control means C, the DC motor M is actuated in response to the detection signal to rotate the cam 4, whereupon the pump P operates to eject a jet of predetermined amount of liquid in droplet form from the nozzle 10.

Figure 3:
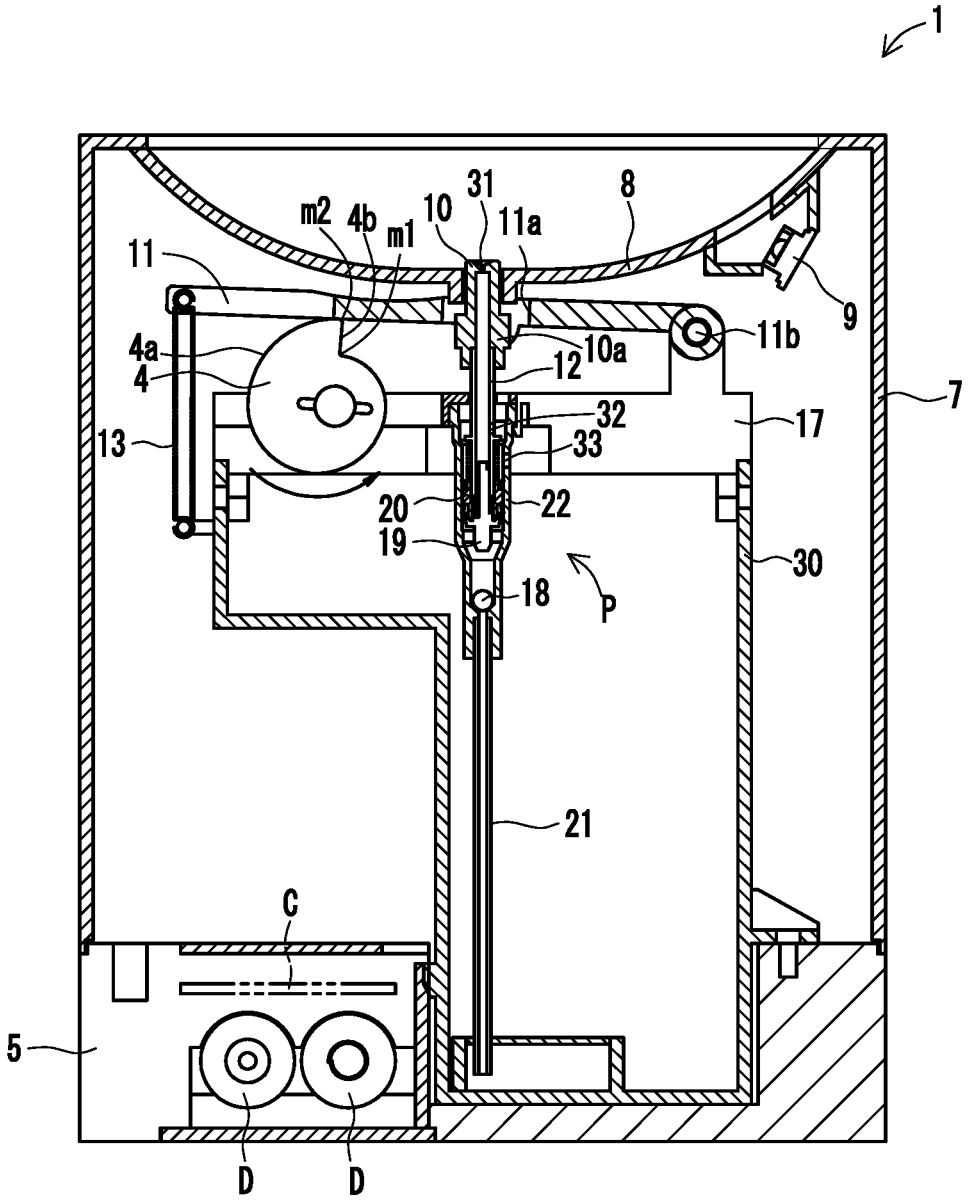
FIG. 3 is a sectional view showing an example of the droplet jetting apparatus.

FIG. 3 is a sectional view showing an example of the droplet jetting apparatus 1. The droplet-jetting nozzle 10 having a jet opening in simple shape, and, a shaft portion 10*a* is disposed in a cylindrical nozzle main body of the nozzle 10. As a lever, a piston cam lever 11 is coupled to the nozzle 10 so as to support the shaft portion 10*a*. The piston cam lever 11 has a hole 11*a*, which is oblong in plan configuration, for supporting the shaft portion 10*a* of the nozzle 10 to minimize the toppling of the nozzle 10 caused by the rocking motion of the piston cam lever 11. Upon rotation of the cam 4, the piston cam lever 11 rocks about a shaft 11*b* thereof serving as a pivotal point. At this time, the shaft 11*b* of the piston cam lever 11 is supported on a piston cam lever support frame 17. Giving an oblong shape to the hole 11*a* of the piston cam lever 11 for supporting the shaft portion 10*a* of the nozzle 10 allows the nozzle 10 to move up and down with minimum toppling movement.

A nozzle-connected pump pipe 12 of the pump P is connected to the nozzle 10 coupled to the piston cam lever 11. To prevent accidental detachment, the nozzle-connected pump pipe 12 is press-fitted, bonded, screw-held, or otherwise fastened to the nozzle 10. The cam 4 is configured to impart up-and-down motion to the nozzle 10 coupled to the piston cam lever 11 and the nozzle-connected pump pipe 12 connected to the nozzle 10 by raising and lowering the piston cam lever 11. The cam 4 has the form of a contoured flat cam having a maximum radius and a minimum radius on the back of the maximum radius. At the maximum radius position, the piston cam lever 11 reaches the maximum position limit.

That is, the cam 4 has a first cam face 4*a* extending from a suction starting point m1 corresponding to the minimum radius, with an increase in radius in the direction of rotation, to a suction ending point m2 corresponding to the maximum radius just ahead of the suction starting point in the rotation direction, and a second cam face 4*b* extending from the suction ending point m2 to the suction starting point m1 with a sharp decrease in radius in the rotation direction.

With the piston cam lever 11 kept in contact with the first cam face 4*a*, the cam 4 is rotated to produce a suction force for the pump P to suck the liquid. Upon further rotation of the cam 4, the piston cam lever 11 is rocked toward the second cam face 4*b* by a spring force of a tension spring 13 for discharge of the liquid out of the pump P.

The piston cam lever 11 is provided with the tension spring 13. When the pump P is filled to capacity, the tension spring 13 is pulled, whereas, when the diameter of the cam is reduced to a minimum, the tension spring 13 exerts a spring force to press the piston cam lever 11 down. When the nozzle 10 connected to the piston cam lever 11 and the nozzle-connected pump pipe 12 are pressed down correspondingly, the pump P is subjected to pressure. The level of the pressure applied to the pump P can be changed on an as needed basis by controlling the operation of the tension spring 13.

Figure 4:
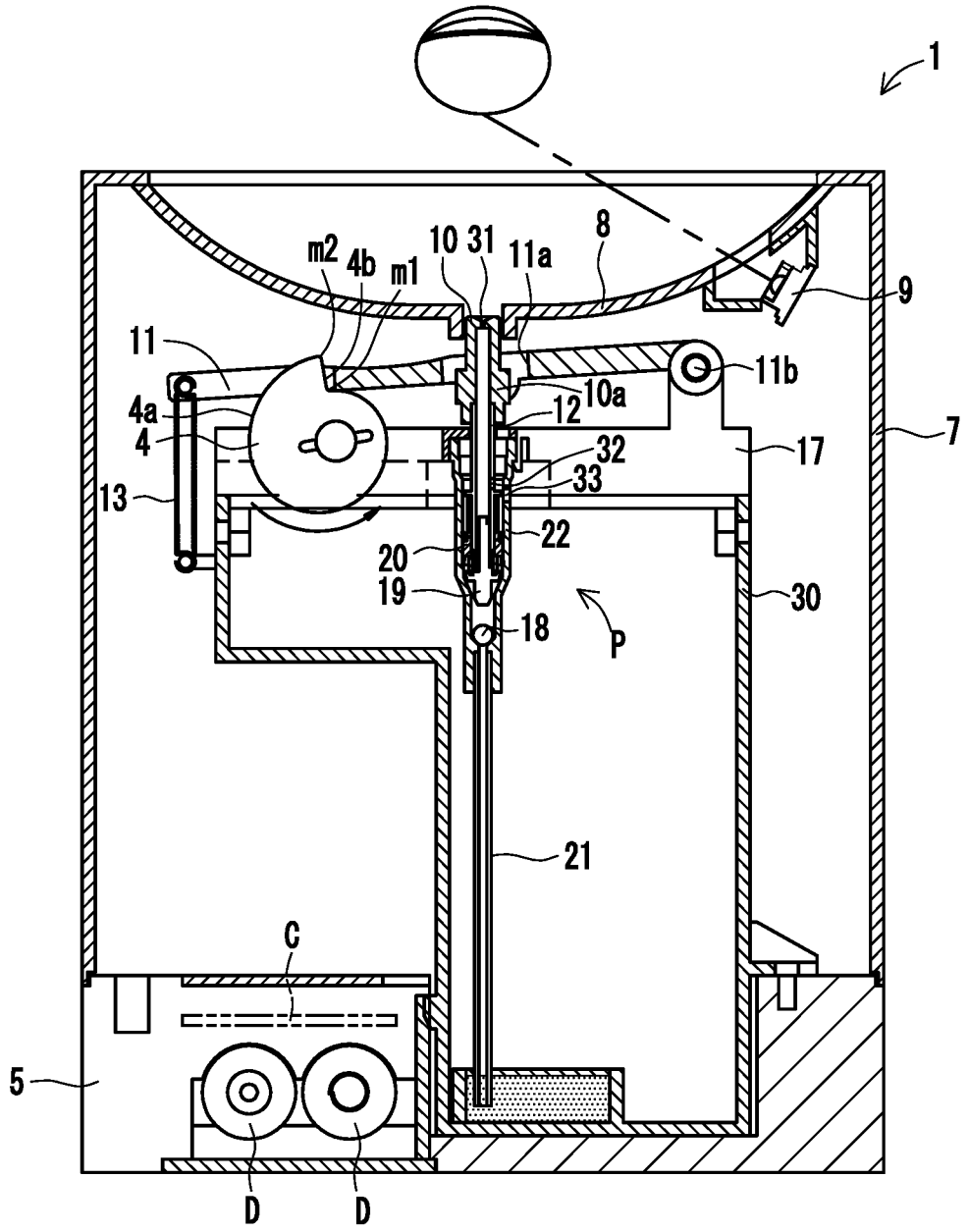
FIG. 4 is a sectional view showing an example of the apparatus in a condition where the cam has just started to rotate upon detection of a hand by the object detection sensor.
Figure 5:
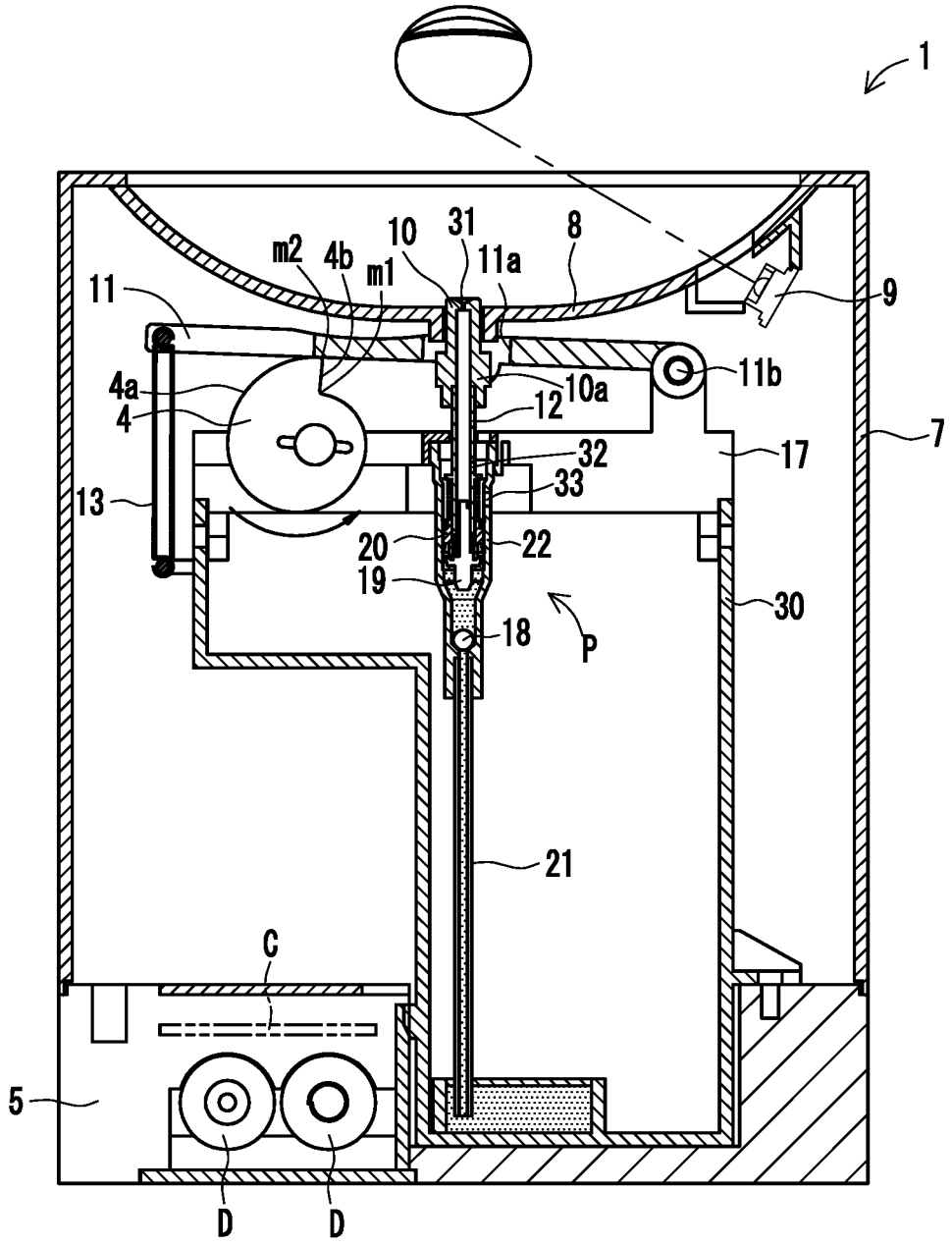
FIG. 5 is a sectional view showing an example of the apparatus in a condition where the pump is filled to capacity as a result of liquid suction under rotation of the cam.
Figure 6:
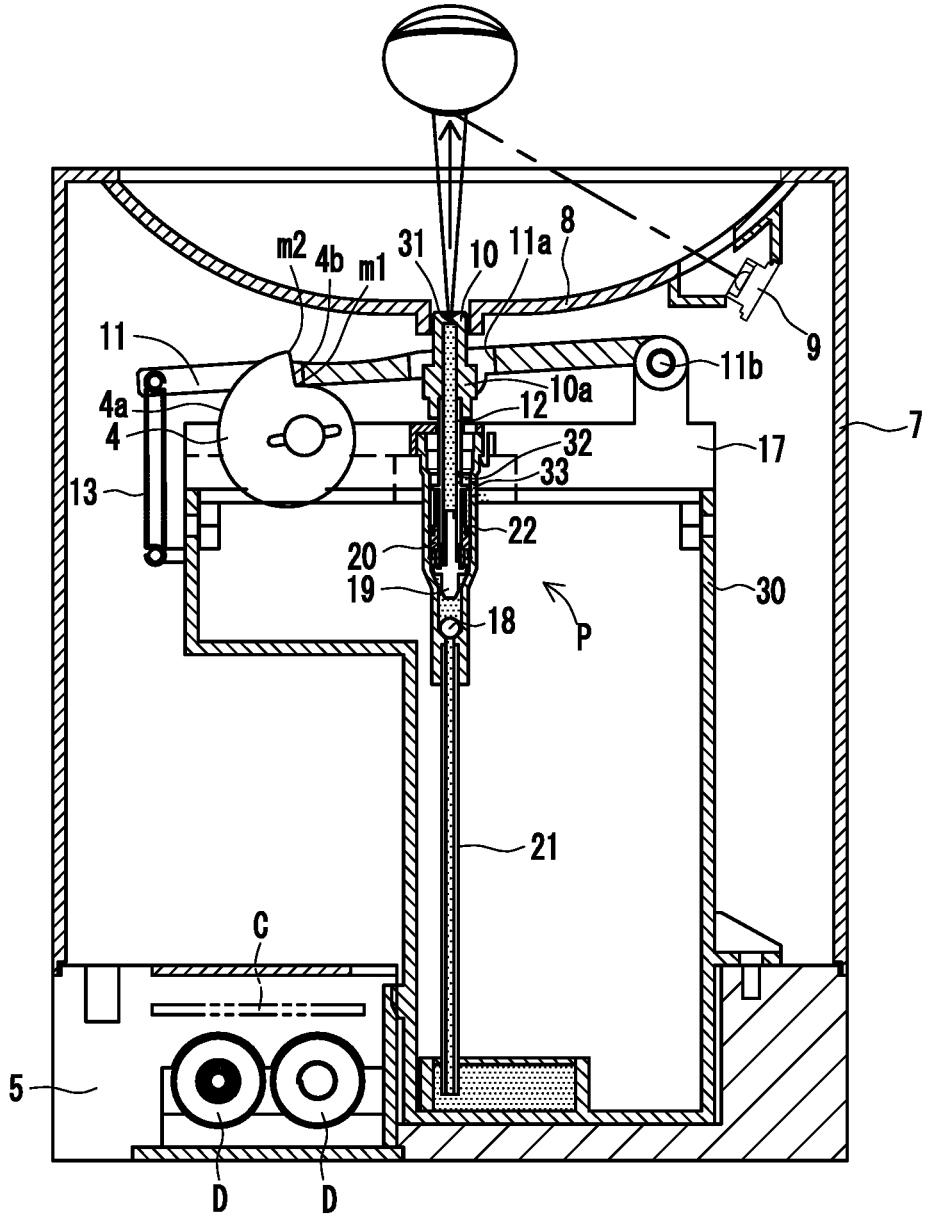
FIG. 6 is a sectional view showing an example of the apparatus in a condition where the liquid present in the pump has just been squeezed out of the nozzle in the form of a jet of droplets upon the shift of the piston cam lever from the suction ending point to the suction starting point.

FIG. 4 is a sectional view showing an example of the apparatus in a condition where the cam 4 has just started to rotate upon detection of a hand by the object detection sensor 9. FIG. 5 is a sectional view showing an example of the apparatus in a condition where the pump P is filled to capacity as a result of liquid suction under rotation of the cam 4. FIG. 6 is a sectional view showing an example of the apparatus in a condition where the liquid present in the pump P has just been squeezed out of the nozzle 10 in the form of a jet of droplets upon the shift of the piston cam lever 11 from the suction ending point m2 to the suction starting point m1.

When the liquid droplet-impingement target object is detected by the object detection sensor 9, the apparatus repeats the cycle of operation thus far described. On the other hand, when no target object is detected by the object detection sensor 9, the apparatus is maintained in a standby state. As shown in FIG. 4, at times when the liquid droplet-impingement target object is detected, a first valve 18 is closed, whereas a second valve 19 is opened. At this time, the closure of the second valve 19 presents no problem.

Suction operation proceeds as follows with sequential reference to FIG. 4 and FIG. 5. As shown in FIG. 5, a piston 20 is raised by rotation of the cam 4, and, the second valve 19 and the piston 20 are brought into a closed state, whereupon the system goes into suction mode. After the first valve 18 is opened under a suction force exerted by the piston 20, the liquid is sucked in conjunction with the suction movement of the piston 20 until the maximum radius part of the cam 4 takes a turn. On completion of liquid suction, the first valve 18 is closed. Moreover, the tension spring 13 attached to the piston cam lever 11 is pulled in conjunction with the movement of the cam 4.

Then, as shown in FIG. 6, with a shift from the maximum radius part to the minimum radius part in the cam 4, the tension spring 13 is returned to its original condition, and, by the spring force of the tension spring 13 exerted at this time, the nozzle 10 is pressed down via the piston cam lever 11 with consequent application of a force to the piston 20 attached to the nozzle-connected pump pipe 12. Then, the liquid is subjected to a pressing force exerted by the piston 20, and the closed second valve 19 is opened. Under the pressing force, a jet of liquid droplets is ejected from the nozzle 10 so as to impinge on and wet the liquid droplet-impingement target object. A jet of liquid is preferably ejected within at most two seconds, or more preferably within one second, after the liquid droplet-impingement target object is detected by the object detection sensor 9.

Moreover, the ejection amount of liquid can be adjusted by controlling the stroke of the piston 20 based on the difference between the maximum radius and the minimum radius in the cam 4. It is preferable that a suction capacity V1 for suction in the range from a suction pipe 21 to the first valve 18 is smaller than a suction capacity V2 at the maximum stroke L of the piston 20.

Figure 7:
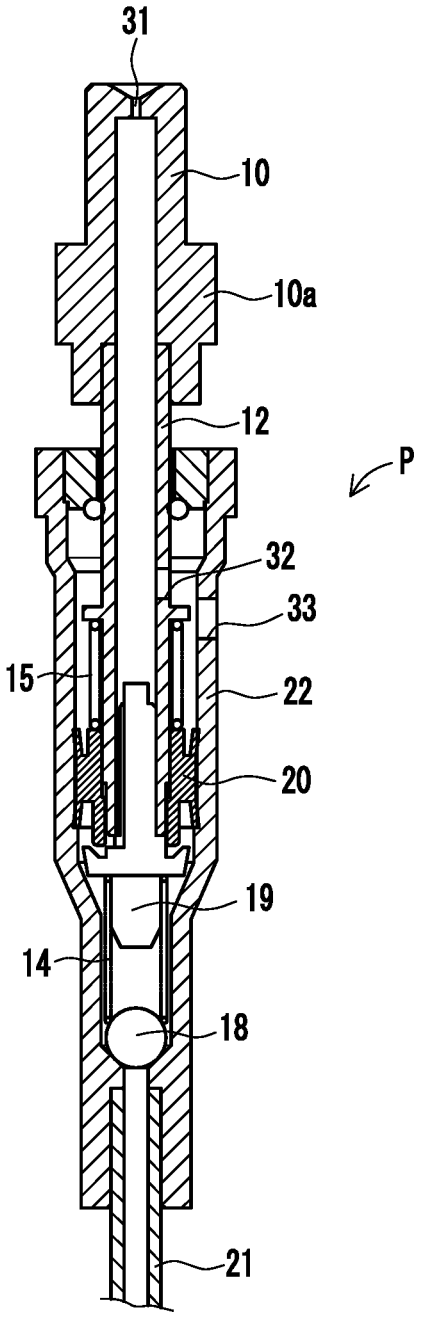
FIG. 7 is an enlarged sectional view showing an example of the pump.

The following describes another ejection amount control method according to the invention with reference to FIG. 7.

Figure 8:
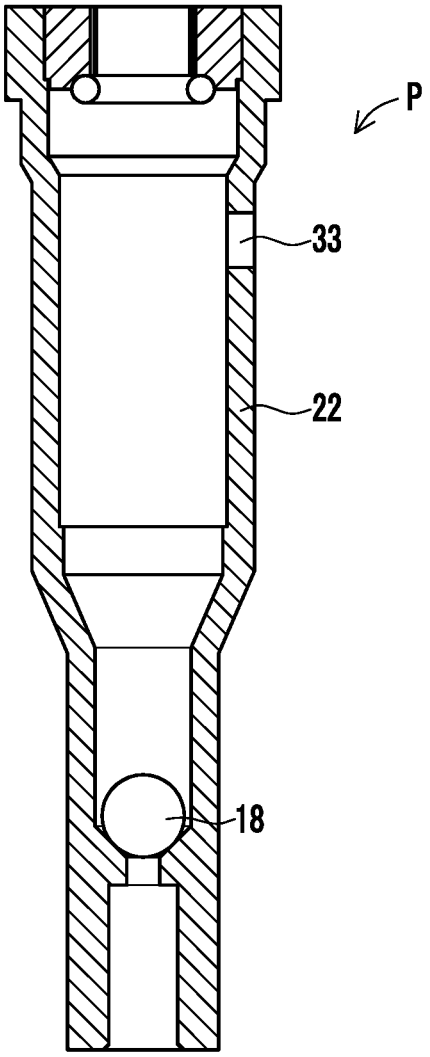
FIG. 8 is an enlarged sectional view showing an example of the cylinder of the pump.

FIG. 7 is an enlarged sectional view showing an example of the pump 1 in accordance with one embodiment of the invention. FIG. 8 is an enlarged sectional view showing an example of the cylinder of the pump. As shown in FIG. 7 and FIG. 8, for stable liquid ejection under ejection amount control, the nozzle-connected pump pipe 12 connected to the nozzle 10 has an adjustment hole 32 (inside diameter: d2) formed in its side surface, and an outlet hole 33 (inside diameter: d3), which is greater in inside diameter than the adjustment hole 32, formed in a side surface of a cylinder. The apparatus is required to allow a jet of liquid to impinge on a desired area without causing dripping of the liquid. As described earlier, in order to make a jet of liquid impinge on, for example, a hand without causing dripping of liquid droplets, the amount of liquid droplets impinging on the hand needs to be adjusted to a very low level.

With this in view, the invention notes the need to control the ejection amount from the nozzle 10. In the embodiment, on the basis of the preset force for the suction of a necessary and sufficient amount of liquid with the stroke L of the piston 20 and area ratio between the adjustment hole 32 (inside diameter: d2) formed in the side surface of the nozzle-connected pump pipe 12 and a nozzle hole 31 (inside diameter: d1), a required ejection amount is determined.

The suction of a necessary and sufficient amount of liquid is achieved under the condition that the suction capacity V2 at a single stroke L of the piston 20 is greater than the suction capacity V1 for suction of the liquid passing through the suction pipe 21 and then the first valve 18. The fulfillment of such a condition makes it possible to fill the interior of the suction pipe 21 extending up to the first valve 18 with the liquid with consequent production of a vacuum, and thereby effect the second suction and each suction thereafter without fail.

On the basis of the area of the nozzle hole 31 (inside diameter: d1) and the area of the adjustment hole 32 (inside diameter: d2) formed in the side surface of the nozzle-connected pump pipe 12, the area proportion of the nozzle hole 31 (inside diameter: d1) may be set so that the required ejection amount is obtained. Alternatively, with the selection of the nozzle hole 31 (inside diameter: d1), the area proportion of the adjustment hole 32 (inside diameter: d2) formed in the side surface of the nozzle-connected pump pipe 12 may be set so that the required ejection amount is obtained on the basis of the area proportion of the nozzle hole 31 (inside diameter: d1).

Thus, ejection of a required little amount of liquid can be achieved by forming the adjustment hole 32 (inside diameter: d2) in the side surface of the nozzle-connected pump pipe 12 for the passage of liquid at low cost.

A compression spring 14 may be provided as a spring for closing the first valve 18. For example, in the pump P substantially vertically oriented, where the cylinder for receiving the first valve 18 is conical in shape, a valve effect can be obtained with use of a spherical body made of metal or glass bead for the first valve 18. Also, such a first valve 18 exhibits the valve effect under its own weight. On the other hand, in the pump P substantially horizontally oriented, it is desirable to provide the compression spring 14.

Moreover, in view of the leakage of an excess of liquid through the adjustment hole 32 formed in the side surface of the nozzle-connected pump pipe 12 within the pump P, the side surface of a cylinder 22 is provided with an outlet hole 33 (inside diameter: d3) which is larger than the adjustment hole 32 (inside diameter: d2) formed in the side surface of the nozzle-connected pump pipe 12.

This arrangement achieves stable ejection of a little amount of liquid. The leaked liquid from the outlet hole 33 (inside diameter: d3) formed in the side surface of the cylinder 22 is returned to a container 30 containing the liquid. This makes it possible to use the liquid efficiently and thereby reduce consumption of a variety of liquids stored in a liquid feed tank 34 detachably attached to the main body 5 so as to lie on one side of the peripheral wall 7, including water for liquid supply, an antiseptic solution such as alcohol, and a cleaning solution.

As described hereinabove, the droplet jetting apparatus 1 is capable of ejecting a jet of a little amount of liquid in droplet form, and yet has inexpensively manufacturable workings. In this construction, with use of the piston pump having a reciprocating movement and the nozzle 10 formed with the nozzle hole 31 in simple circular shape, the pressure applied to the pump P is adjusted via the tension spring 13, and, the ejection amount of liquid is adjusted to a very low level by controlling the stroke L of the piston 20 or the aperture ratio between the nozzle hole 31 and the adjustment hole 32 formed in the side surface of the nozzle-connected pump pipe 12. By such ejection means, the apparatus automatically ejects a jet of liquid upon detection of the liquid droplet-impingement target object by the object detection sensor 9 serving as detecting means.

EXPERIMENTAL EXAMPLES

Figure 9:
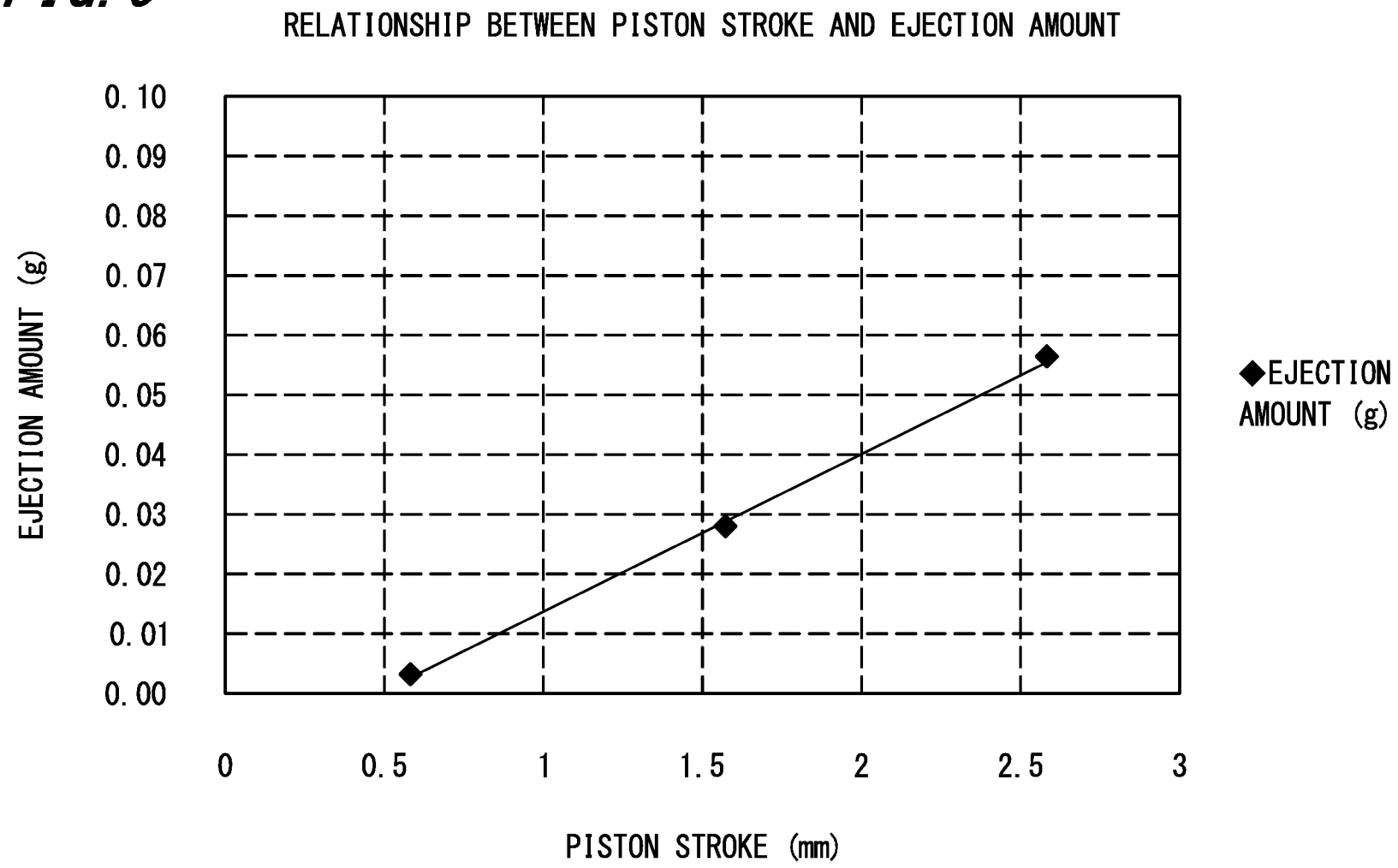
FIG. 9 is a graph showing an example of the relationship between piston stroke and ejection amount.

Experimental examples of the apparatus have been tested for the amount of water ejection at one reciprocating motion of the piston 20 under the following conditions: the nozzle hole 31 of the nozzle 10 for liquid ejection has a simple circular shape with a diameter of 0.4 mm; the inside diameter of the liquid path is 2 mm; the maximum radius part and the minimum radius part in the cam 4 work in shifts; the shift amount of the first cam face 4*a* and the second cam face 4*b* is varied; neither of the nozzle-connected pump pipe 12 and the cylinder has a hole such as the outlet hole 33 formed in the side surface thereof; the amount of tension on the tension spring 13 of the piston cam lever 11 is about 500 g; the inside diameter of the cylinder is 6.1 mm; and water is used as the liquid. Table 1 and FIG. 9 provide experimental and diagrammatic data.

In the measurement, a jet of liquid was caused to impinge on a glass plate placed above the nozzle 10, and the weight of the liquid was measured with an electronic balance.

TABLE 1

| | Shift amount of First cam face and Second cam face = Cam shoulder (mm) | Piston Stroke (mm) | Ejection amount (g) |
|---|---|---|---|
| Test 1 | 1.82 | 0.58 | 0.0030 |
| Test 2 | 3.62 | 1.58 | 0.0278 |
| Test 3 | 5.41 | 2.58 | 0.0564 |
| | | Slope | 0.0267 |
| | | Section | −0.0131 |
| | | Correlation coefficient | 0.998 |

As seen from Table 1 and FIG. 9, in this apparatus, the stroke L of the piston 20 and the ejection amount vary in substantially linear relation to each other according to the shift amount of the first cam face 4*a* and the second cam face 4*b*. That is, the stroke L of the piston 20 varies with a shift of the shoulder of the cam 4, and this permits control of the amount of water (liquid) ejection. To avoid that liquid dripping will occur depending on the area of impingement and the surface tension of the liquid, the cam 4 that defines the stroke L of the piston 20 is provided with a shoulder to obtain the shift amount of the first cam face 4*a* and the second cam face 4*b*, so that the ejection amount can be adjusted to an extent that would prevent dripping of the liquid impinging on a target surface.

It is preferable that the suction capacity V1 at the stroke L of the piston 20 in suctioning operation is greater than the suction capacity V2 for suction in the range from the bottom side of the suction pipe 21 for the passage of liquid to the first valve 18.

Figure 10:
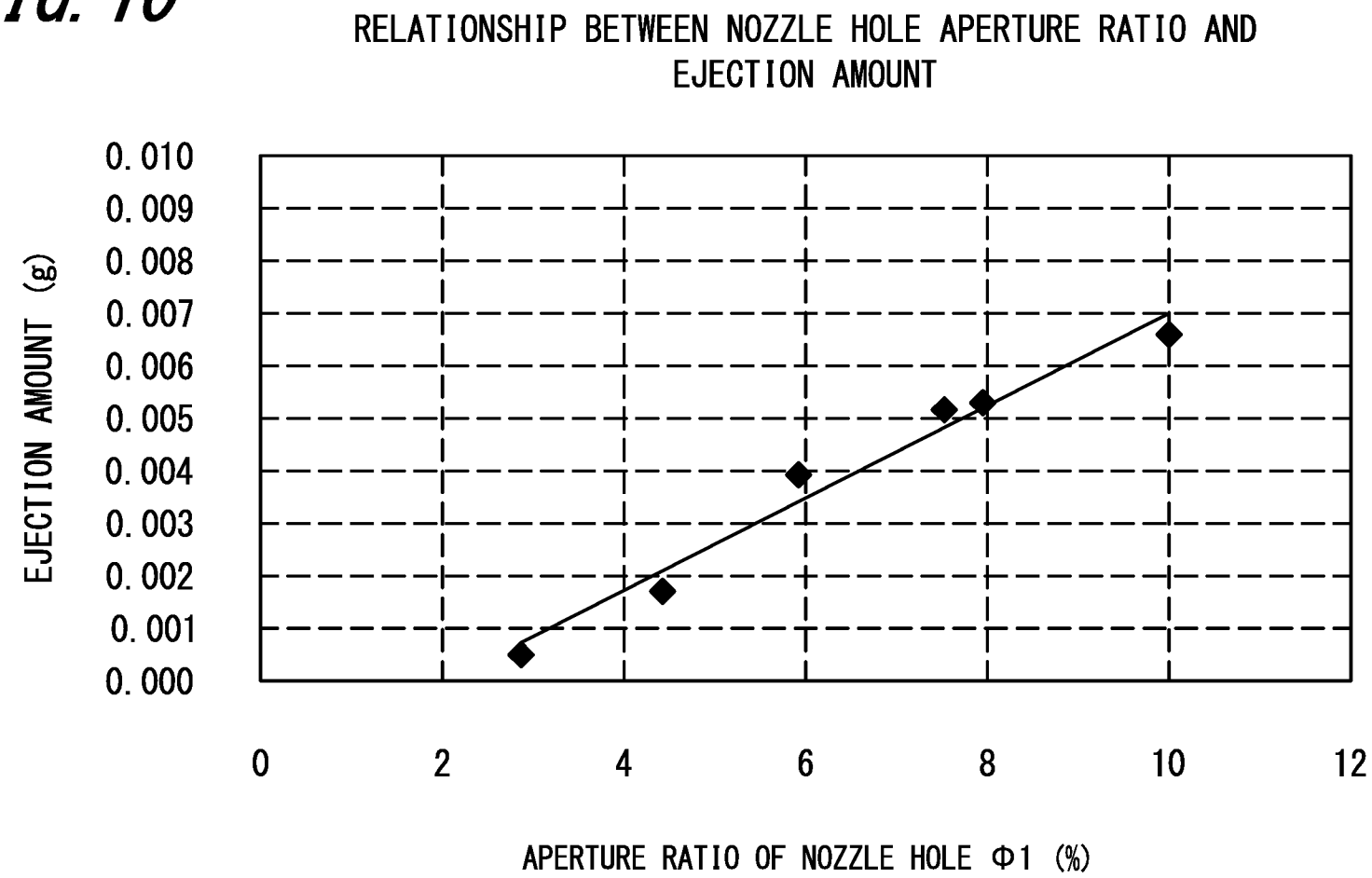
FIG. 10 is a graph showing an example of the relationship between the aperture ratio of the nozzle hole and the ejection rate, which holds when the ejection amount of liquid for the case where the side surface of the nozzle-connected pump pipe is free of a hole is given as 100%.

Examples of the apparatus have been tested for the ejection amount under the condition that the nozzle-connected pump pipe 12 has a hole formed in its side surface. Table 2, Table 3, and FIG. 10 provide practical exemplification data. As seen from Table 2, where no adjustment hole 32 is formed in the nozzle-connected pump pipe 12, even with a change in nozzle diameter, a jet of liquid is ejected in substantially uniform amount.

TABLE 2

| Diameter of hole in nozzle-connected pipe's side surface (mm) | Nozzle diameter (mm) 0.3 Ejection amount (g) | 0.4 Ejection amount (g) | 0.5 Ejection amount (g) |
|---|---|---|---|
| 0 | 0.0564 | 0.0558 | 0.0557 |
| 1.5 | 0.0017 | 0.0060 | 0.0066 |
| 1.75 | 0.0005 | 0.0039 | 0.0053 |
| 2 | 0.0003 | 0.0005 | 0.0004 |

Remarks: Inside diameter of nozzle-connected pipe $\varphi = 2$ mm

The formation of the adjustment hole 32 in the side surface of the nozzle-connected pump pipe 12 for the passage of liquid achieves control of the ejection amount in a manner such that, the larger the adjustment hole 32, the smaller the ejection amount. Moreover, with the formation of the adjustment hole 32 (inside diameter: d2) in the side surface of the nozzle-connected pump pipe 12 for the passage of liquid and the reduction of the dimensions of the nozzle hole 31 of the nozzle 10, the ejection amount can be adjusted to a very low level. It is preferable that the cross-sectional area of the adjustment hole 32 (inside diameter: d2) formed in the side surface of the nozzle-connected pump pipe 12 for the passage of liquid is smaller than the cross-sectional area of the diametrical section of the interior of the nozzle-connected pump pipe 12 serving as the liquid path.

A value obtained by dividing the cross-sectional area of the nozzle hole 31 by the sum of the cross-sectional area of the nozzle hole 31 and the cross-sectional area of the adjustment hole 32 formed in the side surface of the nozzle-connected pump pipe 12 is defined as an area proportion corresponding to the aperture ratio of the nozzle hole 31. Table 3 provides a summary of the relationship between the aperture ratio of the nozzle hole 31 and the ejection amount, and, FIG. 10 is a plot of the data shown in Table 3.

As shown in FIG. 10, where the area of the diametrical section of the interior of the suction pipe 21 is greater than the area of the adjustment hole 32, the ejection amount shows a correlation with the aperture ratio of the nozzle hole 31 of the nozzle 10. Thus, the ejection amount can be adjusted to a very low level by controlling the aperture ratio of the nozzle hole 31 of the nozzle 10.

TABLE 3

| Piston Stroke L = 2.58 mm Aperture ratio of Nozzle hole 31 (%) | Ejection amount (g) |
|---|---|
| 2.85 | 0.0005 |
| 4.39 | 0.0017 |
| 5.88 | 0.0039 |
| 7.55 | 0.0051 |
| 7.96 | 0.0053 |
| 10.00 | 0.0066 |

Remarks: Nozzle hole 31's aperture ratio (%) is defined as area proportion given by the expression $A1/(A1 + A2) \times 100$ = nozzle hole 31 ($\varphi 1$)'s aperture ratio (%), wherein A1 represents the area of hole 31 with inside diameter $\varphi 1$ ($A1 = (\varphi 1/2)^2 \times \pi$), and A2 represents the area of hole 32 with inside diameter $\varphi 2$ ($A2 = (\varphi 2/2)^2 \times \pi$).

Figure 11:
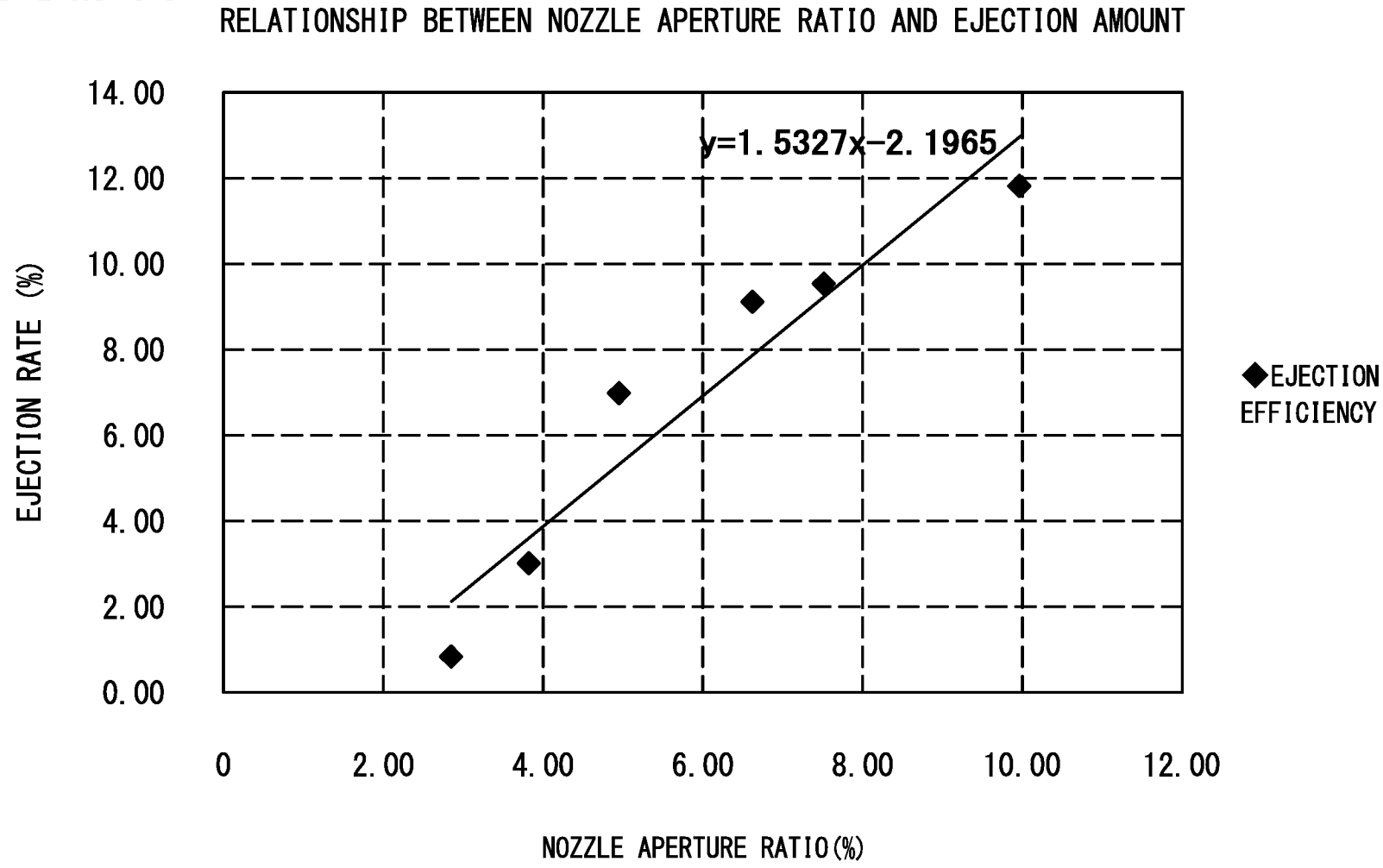
FIG. 11 is a graph showing an example of the result of examination of the flight distance of liquid.

Moreover, FIG. 11 is a plot showing the relationship between the aperture ratio of the nozzle hole 31 and the ejection rate, which holds when the ejection amount of liquid for the case where the side surface of the nozzle-connected pump pipe 12 is free of the adjustment hole 32 is given as 100%. As shown in FIG. 11, there is a substantially linear relationship between the aperture ratio and the ejection rate.

Figure 12:
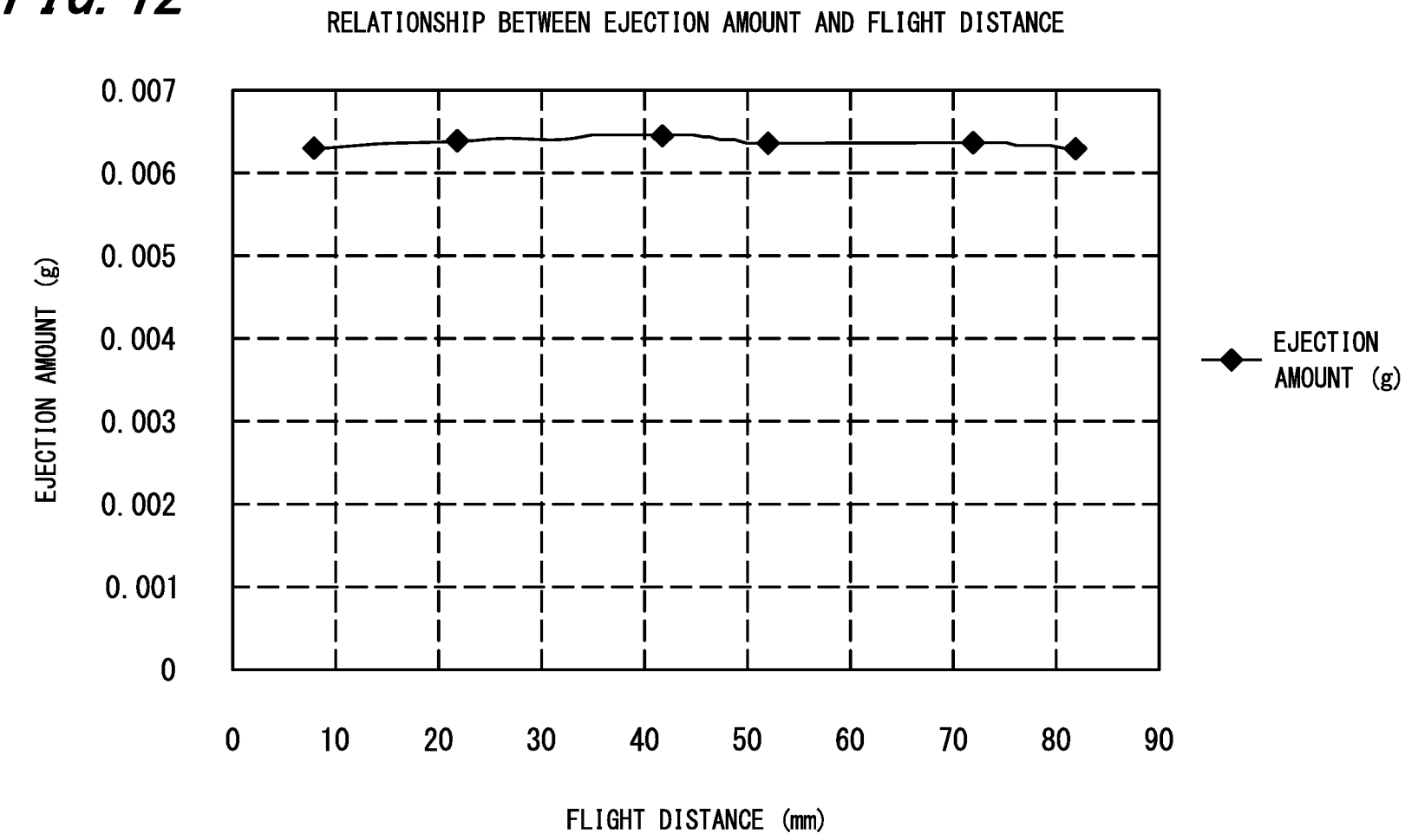
FIG. 12 is a graph showing an example of the result of examination of the spreading characteristics of liquid.

Table 4 and FIG. 12 provide the result of examination of the flight distance of liquid. The ejection amount of a jet of liquid (which is, as exemplified, a jet of water) impinging on a glass plate set face to face with the nozzle 10 has been examined under the following conditions: water is used as the liquid; the inside diameter d1 of the nozzle hole 31 is 0.4 mm; the inside diameter of the nozzle-connected pump pipe 12 is 2 mm; the inside diameter d2 of the adjustment hole 32 formed in the side surface of the nozzle-connected pump pipe 12 is 1.5 mm; and the distance between the nozzle 10 and the glass plate, viz., the flight distance of liquid, is varied. A jet of liquid was directed from below upward in substantially a vertical direction, and, the weight of the liquid which impinged on the glass plate in one step was measured.

As shown in Table 4 and FIG. 12, the ejection amount of liquid from the nozzle 10 varies little so long as the flight distance of liquid falls within the experimental range of about 8 to 80 mm. It will thus be seen that a jet of liquid impinges on an opposed object with ample stability even if the object lies some distance away.

TABLE 4

| Flight distance (mm) | Ejection amount (g) |
|---|---|
| 7.92 | 0.0063 |
| 22 | 0.0064 |
| 42 | 0.00645 |
| 52 | 0.00635 |
| 72 | 0.00635 |
| 82 | 0.0063 |

Figure 13:
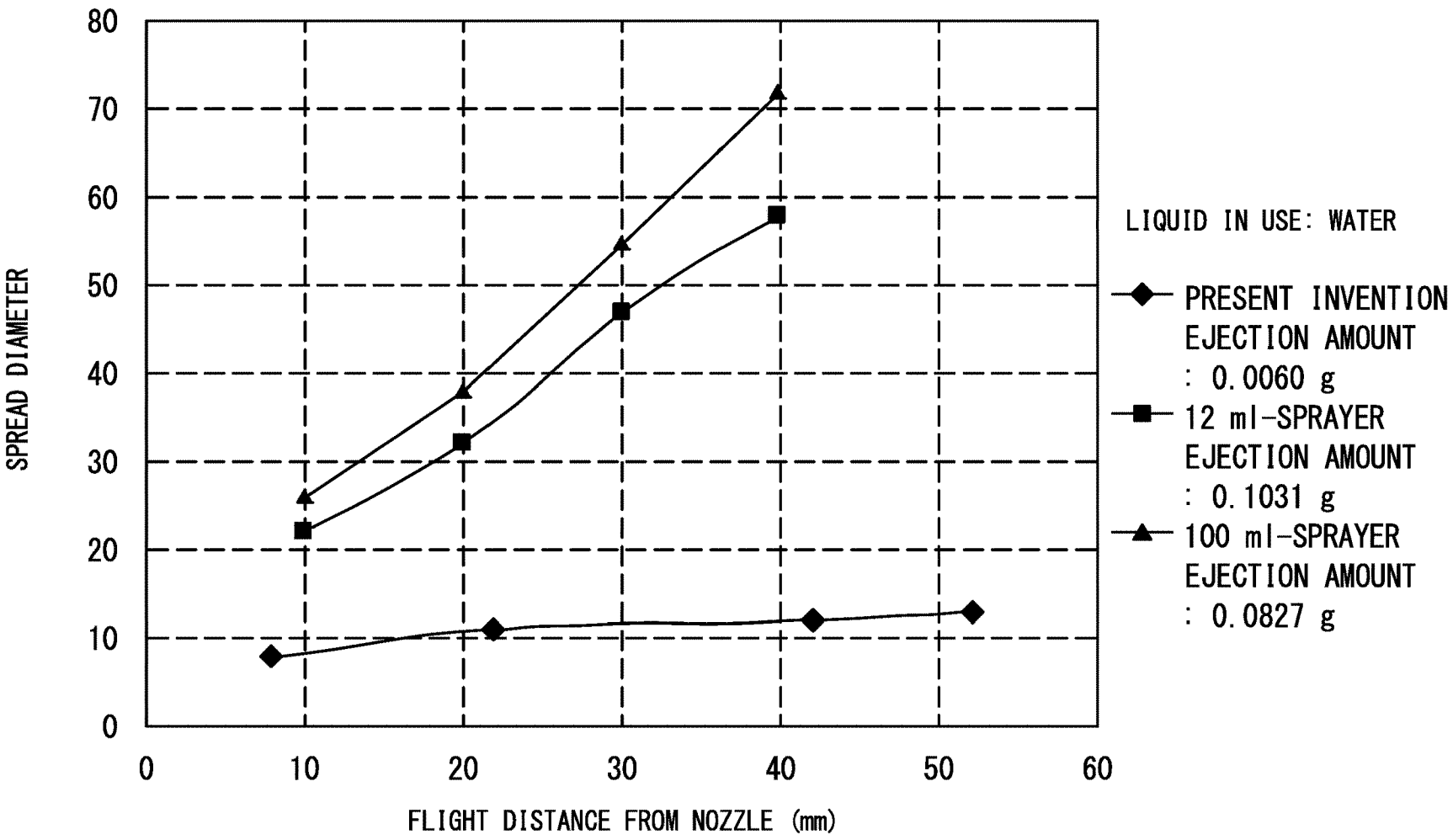
FIG. 13 is a graph showing an example of the relationship between the flight distance of liquid droplets and the diameter of liquid spread.

Table 5 and FIG. 13 provide the result of examination of the spreading characteristics of liquid. The range of the spread of a jet of liquid impinging on a glass plate set face to face with the nozzle 10 has been measured under the following conditions: water is used as the liquid; the inside diameter d1 of the nozzle hole 31 is 0.4 mm; the inside diameter of the nozzle-connected pump pipe 12 is 2 mm; the inside diameter d2 of the adjustment hole 32 formed in the side surface of the nozzle-connected pump pipe 12 is 1.5 mm; and the distance between the nozzle 10 and the glass plate, viz., the flight distance of liquid, is varied. By way of comparative example, a conventional compact and portable sprayer, called an atomizer, was subjected to the same measurement for purposes of comparison.

There is no need to let a jet of liquid spread out over a wide range when it is desired to wet a narrow target such as a hand, a documentary stamp, or a postage stamp with the liquid in a non-contact manner. As to the spreading characteristics of flying liquid according to the invention, as shown in Table 5, the apparatus is capable of keeping the range of spread at a low level even if the flight distance of liquid is as long as a little more than 50 mm. On the other hand, in a conventional compact and portable pump atomizer intended for a different purpose, the range of spread is as great as several tens of millimeters when the flight distance of liquid is 40 mm. The use of this atomizer as a device for wetting a narrow target such as a hand, a documentary stamp, or a postage stamp with liquid may pose a problem such as a loss of liquid or the spread of a spray of liquid to neighboring areas. Such a device does not lend itself to use especially for a business product or the like which may be used by an indefinite number of people. In this regard, in the apparatus, a jet of a little amount of liquid is ejected from the simple circular-shaped nozzle hole 31 of the nozzle 10 under the pressure on the pump P by the spring tension of the tension spring 13. This arrangement allows a jet of liquid to impinge in droplet form on a target without fail while being restrained from spreading, and is thus suitable for use in an apparatus for wetting a narrow object.

As shown in FIG. 13, the apparatus ejects a jet of liquid under pump pressure obtained from the spring tension of the tension spring 13 so that the liquid can fly to impinge on an object, even one located some distance away, without spreading greatly.

TABLE 5

| Example Ejection amount: 0.0060 g | | Comparative example | | |
|---|---|---|---|---|
| | | | 12 ml-sprayer | 100 ml-sprayer |
| Distance from nozzle (mm) | Spread diameter | Distance from nozzle (mm) | Ejection amount: 0.1031 g Spread diameter (mm) | Ejection amount: 0.0827 g Spread diameter (mm) |
| 7.92 | 9 | 10 | 22 | 26 |
| 22 | 11 | 20 | 32 | 38 |
| 42 | 12 | 30 | 47 | 55 |
| 52 | 13 | 40 | 58 | 72 |

Thus, the droplet jetting apparatus 1 according to this embodiment employs the pump P having a reciprocating movement, automatically detects the liquid droplet-impingement target object, operates the cam in a manner to impart reciprocating motion to the pump P, carries out liquid ejection by exploiting pressure and the shoulder of the cam 4 defined by the cam faces 4*a* and 4*b*, ejects a jet of a little amount of liquid with sufficient liquid flight distance by innovative mechanical means, and reduces the spread of the liquid to a limited level on an as needed basis. Note that the amount of freely falling droplets, which varies depending on the surface tension of liquid, may be determined as follows. Given that an upward force is F, the following equation is satisfied:

$$F=2\times\pi\times R\times\gamma\times\cos\theta \quad \text{(Equation 1)},$$

wherein R represents liquid radius and γ represents surface tension.

In this case, the fulfillment of the following relationship avoids causing liquid dripping:

$$M\times g<F \quad \text{(Equation 2)}$$

wherein M represents droplet mass and g represents acceleration of gravity.

As a result of calculation made on the apparatus using water, assuming the radius of droplets of 6 mm (refer to Table 5) and assuming the surface tension of water of 72.75 mN/m, then the droplets fall in an amount of greater than or equal to 0.0285 g. The actually measured weight of water dropped on glass is of the order of about 0.03 g, which is an approximation of the calculated value.

This apparatus controls the radius of droplets (or equivalently the spread of droplets) and the weight of droplets properly to prevent liquid dripping from occurring when a jet of liquid impinges on a droplet-impingement target surface. For example, for the impingement of liquid on a hand, assuming that fingerprint pitch is of the order of about 50 μm and that an area to be wet measures 20 mm by 20 mm, then a required liquid amount is 0.02 g or less, and, the radius of impinging droplets (the radius of the spread of impinging droplets) is 4.2 mm or more. This means that no liquid dripping occurs. Thus, the droplet amount control as practiced in the practical examples eliminates the occurrence of liquid dripping.

Moreover, for prevention of the spread of flying liquid to neighboring areas and a loss of liquid, the range of the spread of impinging liquid should preferably be narrower than the area of a liquid droplet-impingement target object surface. The ejection amount of liquid required to wet a narrow, small-area target such as a postage stamp, a documentary stamp, or a hand is preferably 0.0005 ml or more, or more preferably 0.02 ml or less. Note that the nozzle hole 31 of the nozzle 10 is made of any area and shape required with a liquid droplet-impingement target surface.

A conventional apparatus using a pump mechanism is not required to exercise such a control for ejection of a little amount of liquid droplets as described above, and thus there is no need to form the adjustment hole 32 (inside diameter: d2) in the nozzle-connected pump pipe 12 connected to the nozzle 10 in this construction. The conventional apparatus aims to spray liquid in mist form in a spreading jet, and its piston 20 has a long stroke to obtain a pressure high enough to emit fine spray. That is, the conventional apparatus differs in structure from the apparatus of the invention.

While a light-reflective sensor including a light-emitting portion and a light-receiving portion is used for the object detection sensor 9 for detection of the liquid droplet-impingement target object, by way of another embodiment of the invention, a light-transmissive sensor, a reflective sensor, or an ultrasonic sensor can be used.

Figure 14:
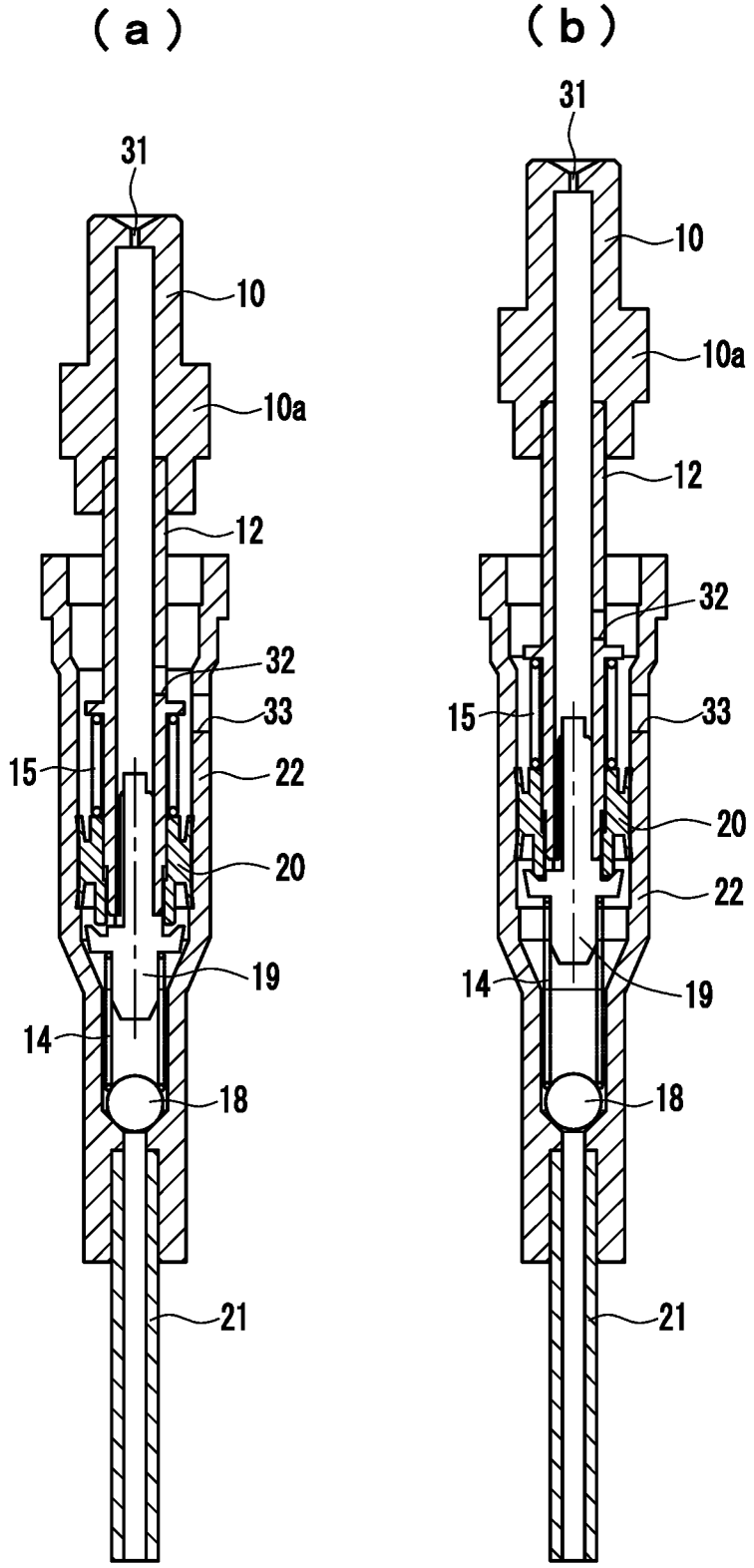
FIGS. 14(*a*) and 14(*b*) show a view showing the relationship between the suction capacity at the stroke of the piston and the suction capacity for suction of the liquid flowing to the first valve.

FIG. 14 is a view showing the relationship between the suction capacity V2 at the stroke L of the piston 20 and the suction capacity V1 for suction of the liquid flowing to the first valve 18. Where V2 is greater than V1, the interior of the suction pipe 21 can be filled with the liquid, and, with the closure of the first valve 18 entailed by returning movement of the piston 20, the liquid filling the interior of the suction pipe 21 flows in a suction direction constantly without flowing back, and consequently stable ejection can be accomplished.

The droplet jetting apparatus 1 according to this embodiment provides the following advantageous effects (1) to (9).

(1) With the droplet jetting apparatus placed on a predetermined mounting surface such as a desk or table, as user's hand or an object is approaching the flight path of liquid droplets, the object detection sensor 9 detects the hand or object, and outputs a detection signal. Upon receipt of the detection signal from the object detection sensor 9, the control means C actuates the driving motor M in response to the detection signal. Upon actuation of the driving motor M, the cam 4 is rotated, and the pump P acts to suck the liquid by rotation of the cam 4. The liquid which has been sucked into the pump is compressed, and is fed, through the discharge portion, to the nozzle 10. A predetermined amount of the liquid in the nozzle 10 is jetted therefrom in droplet form so as to adhere to the hand or object lying in the flight path, so that the hand or object can be wet with an adequate amount of the liquid.

That is, the droplet jetting apparatus 1 ejects a jet of adequate amount of liquid in droplet form by operating the pump P under rotation of the cam 4. Thus, the droplet jetting apparatus 1 can be built as a simply structured, easily and inexpensively manufacturable construction that ejects a jet of liquid, even a little amount of liquid, in droplet form so that the liquid can fly for a required distance without spreading greatly under high responsivity.

(2) The object detection sensor 9 detects a hand or an object at a distance within the range of 5 mm or more and 100 mm or less from the nozzle in the flight path of liquid. Upon one rotation of the cam 4, the pump P operates to eject a jet of liquid in an amount of 0.0005 ml or more from the nozzle 10 so that the area of liquid droplet impingement can be narrower than the area of a liquid droplet-impingement target surface. That is, liquid droplets are ejected in an amount which avoids causing dripping of the liquid from the liquid droplet-impingement target surface (0.02 ml or below) so as to fly for a flight distance of 5 mm or more. Thus, even in a heavy traffic area or even when many people are getting near the apparatus from different directions, the apparatus responds only to the hand of one certain user or one certain object, and then ejects a jet of adequate amount of liquid to adhere the liquid to the hand or object such as a postage stamp without wetting it excessively.

(3) The use of an optical sensor or an ultrasonic sensor for detecting means makes it possible to detect a hand or an object without contact between the droplet jetting apparatus and the hand or object, and thereby provide a clean and sanitary droplet jetting apparatus which is less prone to trouble such as infection and soiling.

(4) Suction movement is imparted to the pump P by rotational movement of the cam 4 from the suction starting point m1 to the suction ending point m2 of the first cam face 4*a*, and, discharge movement is imparted to the pump P by rotational movement of the cam 4 from the suction ending point m2 to the suction starting point m1 of the second cam face 4*b*. Thus, ejection of a jet of desired amount of liquid can be achieved by adjusting the shift amount of the first cam face 4*a* and the second cam face 4*b*.

(5) The driving means includes the piston cam lever 11 coupled to the nozzle 10 for rocking motion in contact with the cam faces 4*a* and 4*b* of the cam 4, and the tension spring 13 that urges the piston cam lever 11 in a direction to press it against the cam face 4*a*, 4*b*. This makes it possible to transmit the shift amount of the cam faces 4*a* and 4*b* based on rotation of the cam 4 to the pump P by simple means, and thereby provide a compact and simply structured droplet jetting apparatus for ejecting a desired amount of flying liquid in an appropriate manner at low cost.

(6) The pump 6 includes: the piston 20; the cylinder 22 that receives therein the piston 20; the suction pipe 21 for the passage of liquid; the first valve 18 that is opened during the sucking of liquid into the cylinder 22, and is closed during the discharge of liquid out of the cylinder 22; and the second valve 19 that is closed during the sucking of liquid into the cylinder 22. Upon movement of the piston 20 in a suction direction, the first valve 18 is opened for the pump to suck the liquid, and, to jet the liquid from the nozzle hole 31 of the nozzle 10, the first valve 18 is closed, whereas the second valve 19 is opened. After passing through the interior of the suction pipe 21, the liquid is ejected in droplet form from the nozzle 10. The first valve 18 and the second valve 19 may be formed of a simply structured check valve. In this case, the construction of the droplet jetting apparatus can be simplified with consequent easy production of the apparatus.

(7) In the pump P, to eject a jet of liquid so that the ejection amount of droplets from the nozzle 10 obtained by one rotation of the cam 4 is adjusted to 0.0005 ml or more and the area of liquid droplet impingement can be narrower than the area of a liquid droplet-impingement target object surface to prevent liquid droplets from dripping from the surface of the object, the stroke L of the piston 20 is controlled with adjustment to the shift amount of the first cam face 4*a* and the second cam face 4*b*, or the suction pipe 21 has the adjustment hole 32 having an inside diameter (d2) smaller than the inside diameter of the suction pipe 21 in the side surface thereof. Thus, the ejection amount of liquid droplet can be controlled with high accuracy.

(8) The suction capacity V2 for suction of the liquid via the pump P with one rotation of the cam 4 is greater than the suction capacity V1 required for the pump P to suck the liquid flowing to the first valve 18, and, the inside diameter d2 of the adjustment hole 32 of the suction pipe 21 is greater than the inside diameter d1 of the nozzle hole 31. This makes it possible to suck the liquid in the amount set for ejection, and draw it into the pump P smoothly without fail. Moreover, in the upper part of the cylinder 22 which falls outside the range of movement of the piston 20, there is provided the outlet hole 33 for the discharge of the leaked liquid from the adjustment hole 32. The inside diameter d3 of the outlet hole 33 is greater than or equal to the inside diameter d2 of the adjustment hole 32. Thus, the cylinder 22 is configured for discharge of the leaked liquid from the pump P through the outlet hole 33. This makes it possible to discharge the liquid in excess of the ejection amount of liquid droplets smoothly without fail, and thereby ensure the required amount of liquid with consequent stabilization of the ejection amount of liquid droplet.

(9) The liquid stored in the droplet jetting apparatus is contained in a replaceable container or a refillable container. This makes it possible to replenish the droplet jetting apparatus with liquid with ease in a sanitary manner at the time of liquid exhaustion, and thereby provide a highly convenient droplet jetting apparatus.

Figure 15:
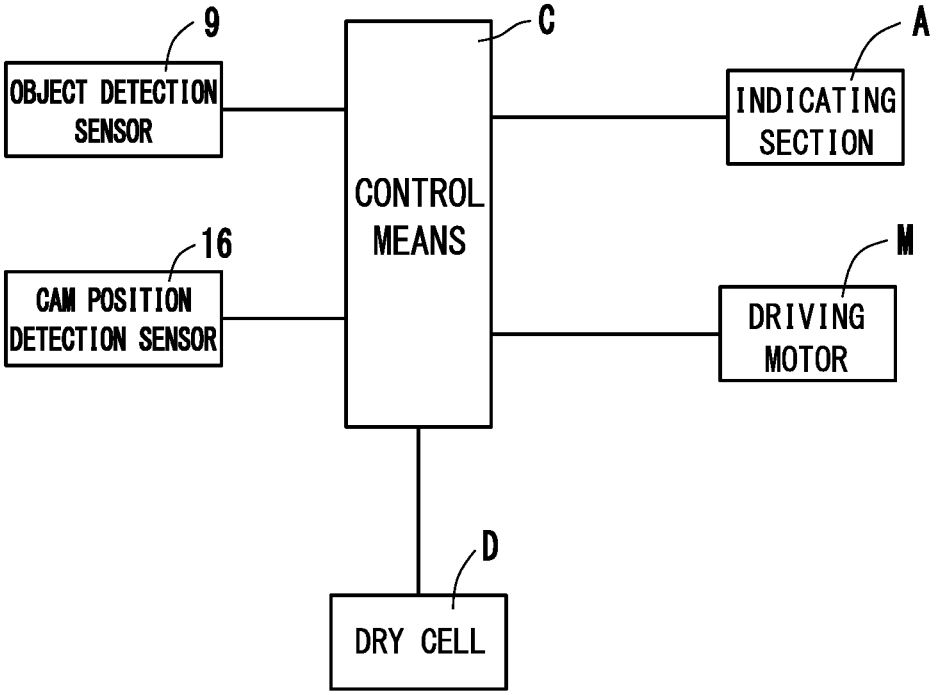
FIG. 15 is a block diagram schematically showing the electrical configuration of the droplet jetting apparatus having control means in accordance with another embodiment of the invention.
Figure 16:
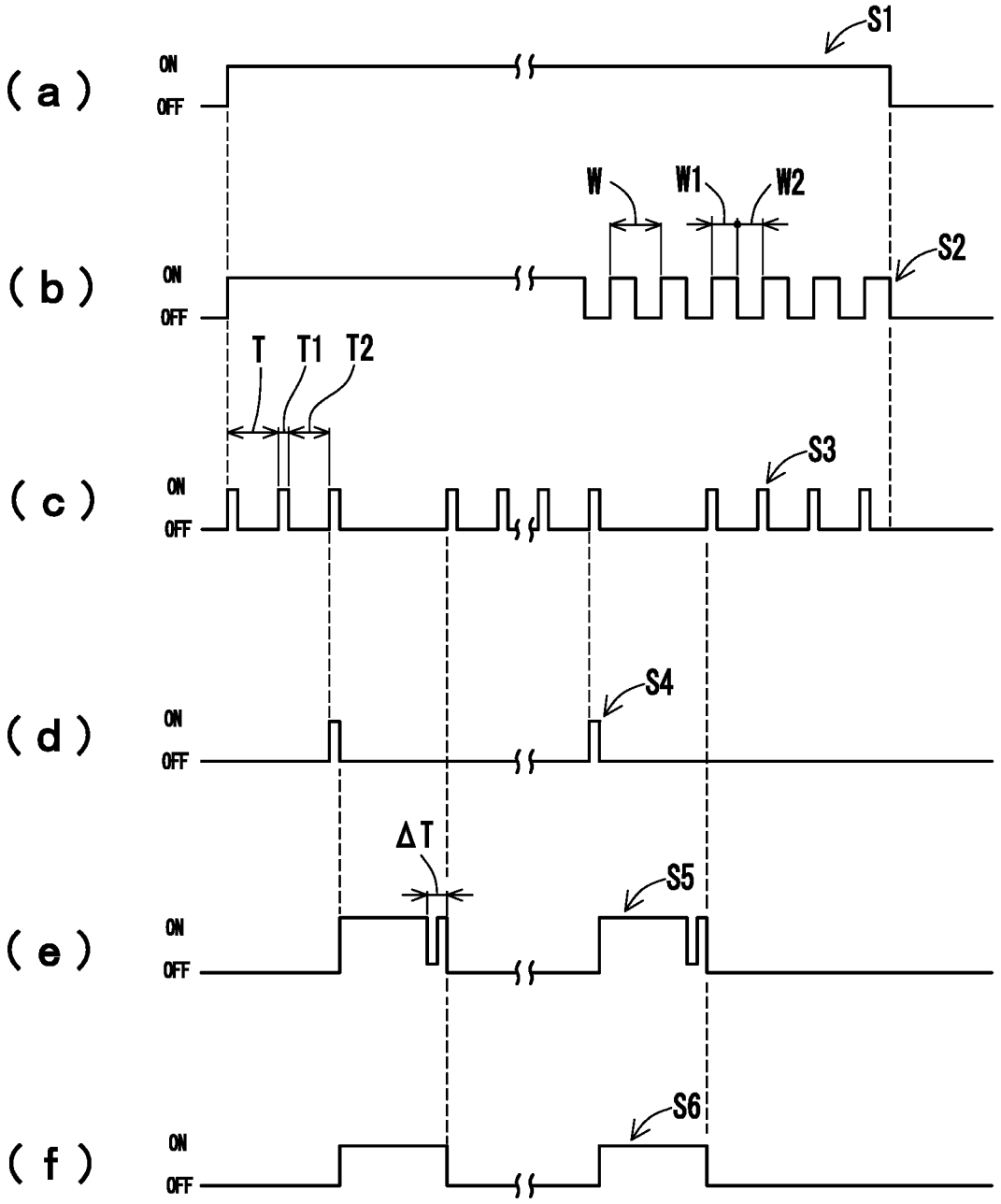
FIGS. 16(*a*)-16(*f*) show a timing chart for explaining the workings of the control means.

FIG. 15 is a block diagram schematically showing an example of the electrical configuration of a droplet jetting apparatus having control means C in accordance with another embodiment of the invention, and, FIG. 16 is a timing chart for explaining the workings of the control means C. The following description deals with the case where the droplet jetting apparatus according to this embodiment is identical in structure with the droplet jetting apparatus 1 according to the preceding embodiment, except the design of the control means C. In FIG. 16, FIG. 16(*a*) is a part showing an ON-OFF signal S1 for ON-OFF control of the apparatus and power supply for the control means C, FIG. 16(*b*) is a part showing an ON-OFF signal S2 for control of an indicating section A of a power indicator lamp by the control means C, FIG. 16(*c*) is a part showing an ON-OFF signal S3 for the object detection sensor 9, FIG. 16(*d*) is a part showing an object detection signal S4 for the object detection sensor 9, FIG. 16(*e*) is a part showing an ON-OFF signal S5 for energization and detection-signal control of the cam position detection sensor 16 by the control means C, and FIG. 16(*f*) is a part showing an ON-OFF signal S6 for control of the driving motor M by the control means C.

In this embodiment, the dry cell D is used as a power source to drive the driving motor M. For reduction in power consumption of the dry cell D, in response to a detection signal outputted from the object detection sensor 9, the control means C exercises ON-OFF control for the application of electric current to the object detection sensor 9 with a pulse signal which exhibits predetermined periodicity, e.g. a period of 2 seconds or less, in which the ratio of ON time is 50% or less. Upon detection of a target by the object detection sensor 9, the control means C allows that electric current is applied to the driving motor M to drive the driving motor M to run, and allows that the electric current to the object detection sensor 9 is interrupted to stop the detecting operation of the object detection sensor 9. Moreover, upon detection of a flag 23 indicative of a predetermined rotational position of the cam 4 by the cam position detection sensor 16, the control means C allows that the electric current to the driving motor M is interrupted to stop the running of the driving motor M, and allows that electric current is applied to the object detection sensor 9 to allow the object detection sensor 9 to start the detecting operation. This results in reduction in the power requirements of the object detection sensor 9 and the driving motor M.

Such control means C may be formed of a controller including: a central processing unit (CPU for short); the object detection sensor 9 for object detection using the dry cell D; the cam position detection sensor 16; a relay for power on-off control of the indicating section A of the power indicator lamp, the driving motor M, etc.; a driving circuit that feeds driving power to the object detection sensor 9, the cam position detection sensor 16, the indicating section A, the driving motor M, etc.; and so forth. Alternatively, the control means C may be formed of a controller including: a sequential control circuit; the object detection sensor 9; the cam position detection sensor 16; the relay for power on-off control of the indicating section A, the driving motor M, etc.; the driving circuit that feeds driving power to the object detection sensor 9, the cam position detection sensor 16, the indicating section A, the driving motor M, etc.; and so forth. Moreover, as the power source, a battery or rechargeable battery may be used in place of the dry cell D.

As shown in FIG. 16(*a*), when power is turned on, the control means C is brought into the ON state. Upon the change from the OFF state to the ON state, as shown in FIG. 16(*b*), under the control of the control means C, a light emitting diode (LED for short), which serves as the indicating section A of the power indicator lamp for indicating operating conditions provided in the droplet jetting apparatus, lights up, and, when the voltage of the dry cell D is lowered to a predetermined level, the signal is changed to a driving signal having a pulse waveform which exhibits a period W defined by ON time W1 and OFF time W2 (the period W=W1+W2), so that the indicating section A can blink. For example, the ON time W1 is set at 500 msec, the OFF time W2 is set at 500 msec, and the period W is set at 1000 msec. The illumination time is controlled so as to indicate the end of the service life of the dry cell D, or equivalently a decrease of the dry cell D capacity to a level where the cell is no longer able to provide power high enough to cope with load application. The duration of the time is freely and suitably selected.

As shown in FIG. 16(*c*), the ON-OFF control for the application of electric current to the object detection sensor 9 is exercised on the basis of a period T defined by ON time T1 and OFF time T2 (the period T=T1+T2), so that the object detection sensor 9 composed of a light-emitting portion and a light-receiving portion can get ready for detection. By setting the ON time T1 for detection at a time interval that permits detection, as contrasted to the case where the indicator stays an always-on condition, reduction in power consumption can be achieved. For example, the ON time T1 for detection is set at 50 msec, the OFF time T2 uninvolved in detection is set at 450 msec, and the detection-indicative illumination period T (=T1+T2) is set at 500 msec as a target detection period.

Thus, the ON time T1 and the period T are set at time intervals that permit detection, and more specifically, the period T is set at 2 seconds or less (set at 500 msec in this embodiment) and the ON time T1 is adjusted to account for 50% or less of the period T (set at 50 msec in this embodiment). That is, the object detection sensor 9 is subjected to ON-OFF control by the control means C using a pulse signal which exhibits a period of 2 seconds or less, in which ON time accounts for 50% or less of the period. This makes it possible to reduce the power requirement of the object detection sensor 9, and thereby provide a highly energy-efficient droplet jetting apparatus.

Moreover, for reduction in power consumption, as shown in FIG. 16(*d*), upon detection of an object by the object detection sensor 9 subjected to ON-OFF control by the control means C, the rise of a detection signal occurs. Then, the control means C supplies power to the cam position detection sensor 16 for energization as shown in FIG. 16(*e*), and drives the driving motor M as shown in FIG. 16(*f*). The drive to the driving motor M allows the cam 4 to rotate, and, following the ejection of liquid, after a predetermined period of time ΔT has elapsed since the application of the flag 23 disposed on the shaft of the cam 4 to the cam position detection sensor 16 was detected by the cam position detection sensor 16, the control means C allows that the electric current to the driving motor M is interrupted to stop the running of the driving motor M, and also allows that the electric current to the cam position detection sensor 16 is interrupted. During the operation of the driving motor M, as shown in FIG. 16(*e*), the electric current to the object detection sensor 9 is interrupted with consequent reduction in power consumption. For example, given that the ejection of liquid is effected at intervals of 1000 msec, then the driving motor M-driving time is about 1000 msec, during which period the electric current to the object detection sensor 9 is being interrupted for about 1000 msec with consequent reduction in power consumption.

Thus, the control means C exercises periodical control for the supply of power to the object detection sensor 9. That is, during the operation of the driving motor M, the supply of power to the object detection sensor 9 is stopped. This makes it possible to reduce power consumption and thereby increase the service life of the dry cell D.

Moreover, as indicated by an alphanumeric character S6, while the application of electric current to the cam position detection sensor 16 for detection of the position of the cam 4 is being carried out during the operation of the driving motor M, the electric current to the object detection sensor 9 is interrupted. Then, upon detection of the cam position by the cam position detection sensor 16, the driving motor M is brought to a stop, and the electric current to the cam position detection sensor 16 is interrupted. This makes it possible to achieve further reduction in power consumption and thereby provide a droplet jetting apparatus that achieves greater energy efficiency.

Moreover, where the droplet jetting apparatus is equipped with a LED, power-saving control is exercised by the control means C. In this case, the LED is subjected to pulse-based control to achieve required light emission with low power consumption. When the voltage of the dry cell D is lowered to a predetermined level, the LED blinks to make it known that the cell life is about to end. A timer may be disposed on the circuitry of the control means C. In this case, an interval preset in the timer or the duration of out-of-service time is clocked, and, in accordance with the timing result, after expiration of the preset time or out-of-service time, the control means C powers off the droplet jetting apparatus.

Thus, even with use of power supply having limited battery capacity, the droplet jetting apparatus according to the embodiment achieves, in addition to the above-described advantageous effects (1) to (9), reduction in power consumption of the battery for power saving, and, on an as needed basis, exercises suitable power consumption control to increase the service life of battery.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

REFERENCE SIGNS LIST

1: Droplet jetting apparatus
2: Gear train
3: Shaft
4: Cam
5: Main body
6: Main body cover
7: Peripheral wall
8: Bowl portion
9: Object detection sensor
10: Nozzle
10*a*: Shaft portion disposed in the nozzle
11: Piston cam lever
11*a*: Hole
11*b*: Pivot point shaft of the piston com lever
12: Nozzle-connected pump pipe
13: Tension spring
14: Compression spring (for first valve)
15: Compression spring (for second valve)
16: Cam position detection sensor
17: Piston cam lever support frame
18: First valve
19: Second valve
20: Piston
21: Suction pipe
22: Cylinder
23: Flag
30: Container
31: Nozzle hole (d1)
32: Hole formed in a side surface of the nozzle-connected pump pipe (d2)
33: Hole formed in a side of the cylinder (d3)
34: Liquid feed tank
C: Control means
D: Dry cell
M: Driving motor
L: Stroke of the piston
P: Pump
V1: Suction capacity
V2: Suction capacity for suction in the range from the bottom side of the suction pipe 21 to the first valve 18

The invention claimed is:

1. A droplet dispensing apparatus which is a compact liquid ejection device and ejects a jet of liquid in droplet form when placed on a predetermined mounting surface, comprising:

a nozzle that ejects a jet of liquid droplets in a predetermined direction;

detecting means that detects a liquid droplet-impingement target object including a hand in a flight path of liquid droplets from the nozzle, and upon detection of the liquid droplet-impingement target object, outputs a target detection signal;

a pump comprising a suction portion for suction of liquid, and a discharge portion which is connected to the nozzle and discharges the liquid which has been sucked into the suction portion;

driving means which comprises a cam and by rotation of the cam, drives the pump to suck liquid and discharge the liquid in a compressed state; and control means which actuates the driving means in response to the detection signal, the control means operating the driving means in a manner to rotate the cam in response to the detection signal, actuating the pump by rotation of the cam, and ejecting a jet of predetermined amount of liquid in droplet form from the nozzle, wherein the cam has a first cam face extending from a suction starting point corresponding to a minimum radius of the cam, with an increase in radius in a rotation direction, to a suction ending point corresponding to a maximum radius of the cam just ahead of the suction starting point in the rotation direction, and a second cam face extending from the suction ending point to the suction starting point with a sharp decrease in radius in the rotation direction.

2. The droplet dispensing apparatus according to claim 1, wherein the detecting means detects the liquid droplet-impingement target object at a distance within a range of 5 mm or more and 100 mm or less from the nozzle in the flight path of liquid droplets, and upon one rotation of the cam, the pump operates to eject a jet of liquid in an amount of 0.0005 ml or more so that an area of liquid droplet impingement is narrower than an area of a liquid droplet-impingement target surface in an amount which avoids causing dripping of liquid droplets from the liquid droplet-impingement target surface, from the nozzle so as to fly for a flight distance of 5 mm or more from the nozzle.

3. The droplet dispensing apparatus according to claim 2, wherein the detecting means is an optical sensor or an ultrasonic sensor.

4. The droplet dispensing apparatus according to claim 1, wherein the driving means includes a lever coupled to the nozzle for rocking motion in contact with the cam face of the cam, and a spring that urges the lever in a direction to press the lever against the cam face, and in order that the liquid is discharged out of the pump, with the lever kept in contact with the first cam face, the cam is rotated to produce a suction force for the pump to suck liquid, and with the lever kept in contact with the second cam face, the cam is rotated to rock the lever by a spring force of the spring.

5. The droplet dispensing apparatus according to claim 1, wherein the pump includes a piston, a cylinder that receives therein the piston, a pipe for passage of liquid, a first valve that is opened during sucking of liquid into the cylinder, and is closed during discharge of liquid out of the cylinder, and a second valve that is closed during sucking of liquid into the cylinder, and when the first valve is closed, upon movement of the piston in a suction direction, the first valve is opened to allow liquid suction, and when the liquid is jetted from a hole of the nozzle, the first valve is closed, whereas the second valve is opened for passage of the liquid through an interior of the pipe, and liquid droplets are jetted from the nozzle.

6. The droplet jetting dispensing apparatus according to claim 5, wherein, in the pump, to eject a jet of liquid such that an ejection amount of liquid droplets from the nozzle obtained by one rotation of the cam is adjusted to 0.0005 ml or more and an area of liquid droplet impingement is narrower than an area of a liquid droplet-impingement target surface to prevent liquid droplets from dripping from the liquid droplet-impingement target surface, a stroke of the piston is controlled with adjustment to a shift amount of a first cam face and a second cam face of the cam, or the pipe has an adjustment hole having an inside diameter smaller than an inside diameter of the pipe in a side surface thereof.

7. The droplet dispensing apparatus according to claim 5, wherein a suction capacity V2 for suction of liquid via the pump with one rotation of the cam is greater than a suction capacity V1 required for suction of liquid flowing to the first valve of the pump, an inside diameter d2 of the adjustment hole of the pipe is greater than an inside diameter d1 of the nozzle hole, an outlet hole for discharge of leaked liquid from the adjustment hole is provided in an upper part of the cylinder which falls outside a range of movement of the piston, and an inside diameter d3 of the outlet hole is greater than or equal to the inside diameter d2 of the adjustment hole so that the leaked liquid from the adjustment hole of the pipe is discharged through the outlet hole.

8. The droplet dispensing apparatus according to claim 5, wherein the liquid is contained in a replaceable container or a refillable container.

9. The droplet dispensing apparatus according to claim 1 wherein the control means exercises ON-OFF control of the detecting means with a pulse signal, and the pulse signal exhibits a period of 2 seconds or less, in which ON time accounts for 50% or less of the period.

10. The droplet dispensing apparatus according to claim 9, wherein the driving means includes a driving motor that rotates the cam, when the detecting means outputs a detection signal, the control means allows that electric current is interrupted to the driving motor to drive the driving motor to run, and allows that electric current to the detecting means is interrupted to stop detecting operation of the detecting means, and when the cam rotationally moves to a predetermined rotational position, the control means allows that electric current to the driving motor is interrupted to stop the running of the driving motor, and allows that electric current is interrupted to the detecting means to allow the detecting means to start detecting operation.

* * * * *